US010507398B2

(12) United States Patent
Choi

(10) Patent No.: US 10,507,398 B2
(45) Date of Patent: Dec. 17, 2019

(54) SHOOTING-TYPE TOY

(71) Applicant: CHOIROCK CONTENTS FACTORY CO., LTD., Seoul (KR)

(72) Inventor: Jong-Ill Choi, Seoul (KR)

(73) Assignee: CHOIROCK CONTENTS FACTORY CO., LTD., Seoul (KR)

( * ) Notice: Subject to any disclaimer, the term of this patent is extended or adjusted under 35 U.S.C. 154(b) by 0 days.

(21) Appl. No.: 15/769,173

(22) PCT Filed: Sep. 29, 2016

(86) PCT No.: PCT/KR2016/010887
§ 371 (c)(1),
(2) Date: Apr. 18, 2018

(87) PCT Pub. No.: WO2017/099339
PCT Pub. Date: Jun. 15, 2017

(65) Prior Publication Data

US 2018/0318724 A1 Nov. 8, 2018

(30) Foreign Application Priority Data

Dec. 7, 2015 (KR) ..... 10-2015-0173450
Dec. 30, 2015 (KR) ..... 10-2015-0190234

(51) Int. Cl.
*A63H 13/10* (2006.01)
*A63H 33/00* (2006.01)
*A63H 29/00* (2006.01)

(52) U.S. Cl.
CPC ..... *A63H 13/10* (2013.01); *A63H 33/003* (2013.01); *A63H 29/00* (2013.01)

(58) Field of Classification Search
CPC ..... A63H 13/10; A63H 33/00; A63H 33/003; A63H 29/00; A63F 9/0252
See application file for complete search history.

(56) References Cited

U.S. PATENT DOCUMENTS 4,583,958 A * 4/1986 Matsuda ..... A63H 5/04 124/27
6,106,356 A * 8/2000 Trageser ..... A63H 17/006 446/429
7,628,674 B2 * 12/2009 Nuttall ..... A63H 18/026 446/444

(Continued)

FOREIGN PATENT DOCUMENTS

JP 7-250972 A 10/1995
JP 9-299623 A 11/1997

(Continued)

OTHER PUBLICATIONS

International Search Report dated Jan. 2, 2017 in corresponding International Patent Application No. PCT/KR2016/010887 (2 pages in English and 2 Pages in Korean).

*Primary Examiner* — Eugene L Kim
*Assistant Examiner* — Alyssa M Hylinski
(74) *Attorney, Agent, or Firm* — NSIP Law

(57) ABSTRACT

The present invention relates to a shooting-type toy, which develops from a first form to a second form when a projectile moved from the outside is inserted therein, and operates such that the inserted projectile is loaded and shot from the second from.

21 Claims, 28 Drawing Sheets

(56) References Cited

U.S. PATENT DOCUMENTS 8,376,806 B2 * 2/2013 Sun ..... A63H 17/006 446/219
8,974,264 B2 * 3/2015 McCafferty ..... A63H 17/008 124/10
8,992,284 B2 * 3/2015 Weidetz ..... A63H 33/003 446/310
9,370,725 B2 * 6/2016 Choi ..... A63H 17/02
2006/0260594 A1 * 11/2006 Andersen ..... A63H 13/10 124/16
2007/0197124 A1 * 8/2007 Sato ..... A63H 33/003 446/129
2008/0064293 A1 * 3/2008 Wade ..... A63H 17/02 446/435
2009/0064979 A1 * 3/2009 Andrews ..... F41B 11/89 124/65
2009/0075556 A1 * 3/2009 Sun ..... A63H 17/008 446/429
2014/0099859 A1 * 4/2014 Weil ..... A63H 17/008 446/435
2014/0346729 A1 * 11/2014 Horikawa ..... A63F 7/2409 273/129 R
2015/0050859 A1 * 2/2015 Choi ..... A63H 17/02 446/72
2015/0093964 A1 * 4/2015 Schmid ..... A63H 17/44 446/476
2018/0078870 A1 * 3/2018 Yu ..... A63H 17/008

FOREIGN PATENT DOCUMENTS

JP 2003-164673 A 6/2003
JP 3612515 B2 1/2005
JP 2012-81199 A 4/2012
JP 2015-504758 A 2/2015
KR 10-1375110 B1 3/2014
KR 10-2014-0125462 A 10/2014
KR 10-1527316 B1 6/2015
KR 10-2015-0099152 A 8/2015

* cited by examiner

SHOOTING-TYPE TOY

CROSS REFERENCE TO RELATED APPLICATIONS

This application is a U.S. National Stage Application of International Application No. PCT/KR2016/010887, filed on Sep. 29, 2016, which claims the benefit under 35 USC 119(a) and 365(b) of Korean Patent Application No. 10-2015-0173450, filed on Dec. 7, 2015, and Korean Patent Application No. 10-2015-0190234, filed on Dec. 30, 2015 in the Korean Intellectual Property Office.

TECHNICAL FIELD

The present invention relates to a shooting type toy, and more particularly, to a shooting type toy that is developed from a first form to a second form if a projectile moving from the outside is inserted thereinto, so that the inserted projectile is loaded and then shot from the shooting type toy in the second form.

BACKGROUND ART

Generally, a transforming toy, which has a robot or car-shaped toy body, transforms from a given form into a second form like a robot or car, and as the single transforming toy produces various forms or structures, accordingly, children can enjoy playing with the transforming toy in various manners.

However, the conventional transforming toy transforms through manual manipulation of a user, and if his or her playing time with the transforming toy is extended anymore, accordingly, his or her interest in the play may be drastically decreased.

On the other hand, shooting play has been proposed to improve the interest in play, and in this case, a projectile such as a marble, medal, disc or the like is shot toward a target located at a given position so that the target falls down.

A conventional technology related to a shooting toy is disclosed in Korean Patent Application Laid-open No. 10-2014-0125462 (entitled 'bullet shooting toy'), wherein the shooting toy includes a toy body, a shooting piece disposed in the toy body, a compression member for moving a bullet placed on the toy body to a front end of the shooting piece, and a restraining member displaceably disposed on the toy body and manipulated by a user to restrain the shooting piece, so that the bullet loaded in the toy body is shot from the toy body by means of the restraining force applied to the shooting piece.

However, the conventional bullet shooting toy just performs the function of shooting the bullet loaded in the toy body by the user, so that the interest in the play may be easily lost.

DISCLOSURE

Technical Problem

Accordingly, the present invention has been made in view of the above-mentioned problems occurring in the prior art, and it is an object of the present invention to provide a shooting type toy that is developed from a first form to a second form if a projectile moving from the outside is inserted thereinto, so that the inserted projectile is loaded and then shot from the shooting type toy in the second form.

Technical Solution

To accomplish the above object, according to the present invention, there is provided a shooting type toy including: a body having a plurality of members; a latch part for locking the body thereonto to allow the body to be kept to a first form; and a projectile moving from the outside in such a manner as to be inserted into the body and thus located in a shooting part disposed in the body, wherein the projectile releases a locking state of the latch part to allow the body to be developed to a second form.

According to the present invention, desirably, if the projectile is located in the shooting part, the projectile is shot from the body developed to the second form by means of a pressurizing part disposed in the body.

According to the present invention, desirably, the shooting type toy further includes pop-up parts rotatably coupled to the body in such a manner as to be developed from the body if the latch part is released from the locking state thereof.

According to the present invention, desirably, the shooting type toy further includes support parts disposed on the body in such a manner as to, if the latch part is released from the locking state thereof, support the body thereagainst to allow the body to rotate forwardly or backwardly or to pop up forwardly, backwardly, upwardly or laterally.

According to the present invention, desirably, each support part includes a plurality of wheels so as to allow the shooting type toy to be driven to an arbitrary direction.

According to the present invention, desirably, the body comprises a body part having an accommodation space formed at the inside thereof; the shooting part is disposed in the body in such a manner as to allow the inserted projectile to be seated and restrained thereinto; the pressurizing part moves the projectile to a front end of the shooting part and pressurizes the projectile thereagainst so that the projectile is shot by means of an elastic force of the shooting part; and the latch part is disposed in the body part in such a manner as to be displaced to a locking position or a locking releasing position by means of the projectile.

According to the present invention, desirably, the body part includes: a body part housing formed of at least one or more members and having a guide portion adapted to guide a moving path of the projectile if the projectile is inserted thereinto; a lever through hole pierced into the body part housing; and a plurality of hinges adapted to support the pop-up parts, the support parts, and the pressurizing part thereagainst in such a manner as to allow the pop-up parts, the support parts, and the pressurizing part to be rotatably coupled to the body part housing.

According to the present invention, desirably, the body part has the first form having at least one selected from mask, combat helmet, shield, car, building, and object, animal's egg, and animal forms, and the second form is at least one selected from animal, robot, dinosaur, and given animation character forms.

According to the present invention, desirably, the shooting part is formed of an arch-shaped elastic body open on one side thereof.

According to the present invention, desirably, the pressurizing part includes: a lever rotatably coupled to the lever through hole; a firing pin connected to the lever on one side thereof and, if the lever operates, adapted to pressurize the projectile against the other side end thereof; and a firing pin spring for providing an elastic force for the firing pin so that the firing pin is kept to a given position.

According to the present invention, desirably, the latch part is displaced through an attractive force generated from a magnetic field with the projectile.

According to the present invention, desirably, the latch part is displaced through physical contact with the projectile.

According to the present invention, desirably, the latch part includes a plurality of locking members adapted to allow the body part and the pop-up parts to be restrainedly kept to the first form, and if the latch part is displaced, adapted to allow the body part and the pop-up parts to be developed.

According to the present invention, desirably, the latch part further includes projectile fixing members for restrainedly fixing the inserted projectile thereto and fixing member springs for providing elastic forces for the projectile fixing members so that the projectile fixing members are kept to given positions.

According to the present invention, desirably, the projectile has any one selected from spherical, circular, polyhedral, polygonal, and cylindrical forms.

According to the present invention, desirably, the projectile is made of a magnetic material or non-magnetic material.

According to the present invention, desirably, the projectile further includes light emitting means disposed therein to emit light therefrom.

According to the present invention, desirably, the projectile further includes at least one member selected from animal, object, characters, numbers, figures, and animation character disposed in an interior thereof.

According to the present invention, desirably, the projectile includes: a projectile housing having projectile through holes formed on the center thereof to seat an auxiliary projectile thereonto; projectile elastic members disposed in the projectile housing to restrain the auxiliary projectile seated onto the projectile through holes thereinto; and the auxiliary projectile seated onto the projectile through holes in such a manner as to be shot by means of the restraining forces of the projectile elastic members.

According to the present invention, desirably, the projectile includes first and second projectile housings, and if the projectile is shot to collide against the ground, an external form of the projectile transforms from a first form into a second form.

According to the present invention, desirably, the first projectile housing and the second projectile housing of the projectile are separably coupled to each other.

According to the present invention, desirably, the shooting type toy further includes an auxiliary pressurizing part coupled to one side of the support part to pressurize the projectile thereagainst from the outside so that the projectile is shot.

Advantageous Effects

According to the present invention, the shooting type toy is developed from the first form to the second form if the projectile moving from the outside is inserted thereinto, thereby improving a child's interest in the play.

In addition, the shooting type toy according to the present invention loads the inserted projectile therein and then shoots the projectile therefrom, thereby more increasing funs in the shooting play.

MODE FOR INVENTION

Hereinafter, an explanation on a shooting type toy according to the present invention will be in detail given with reference to the attached drawing.

First Embodiment

Figure 1:
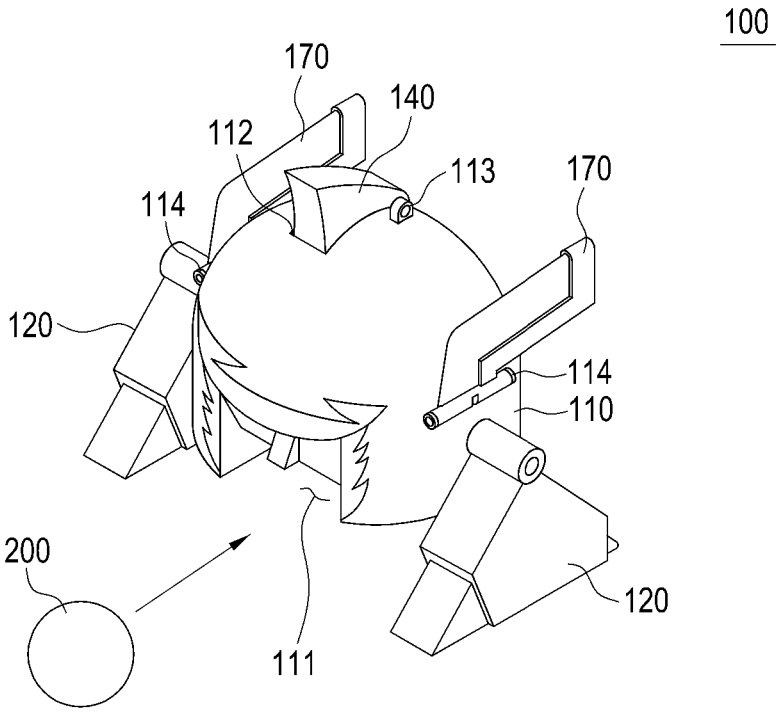
FIG. 1 is a perspective view showing a shooting type toy according to a first embodiment of the present invention.
Figure 2:
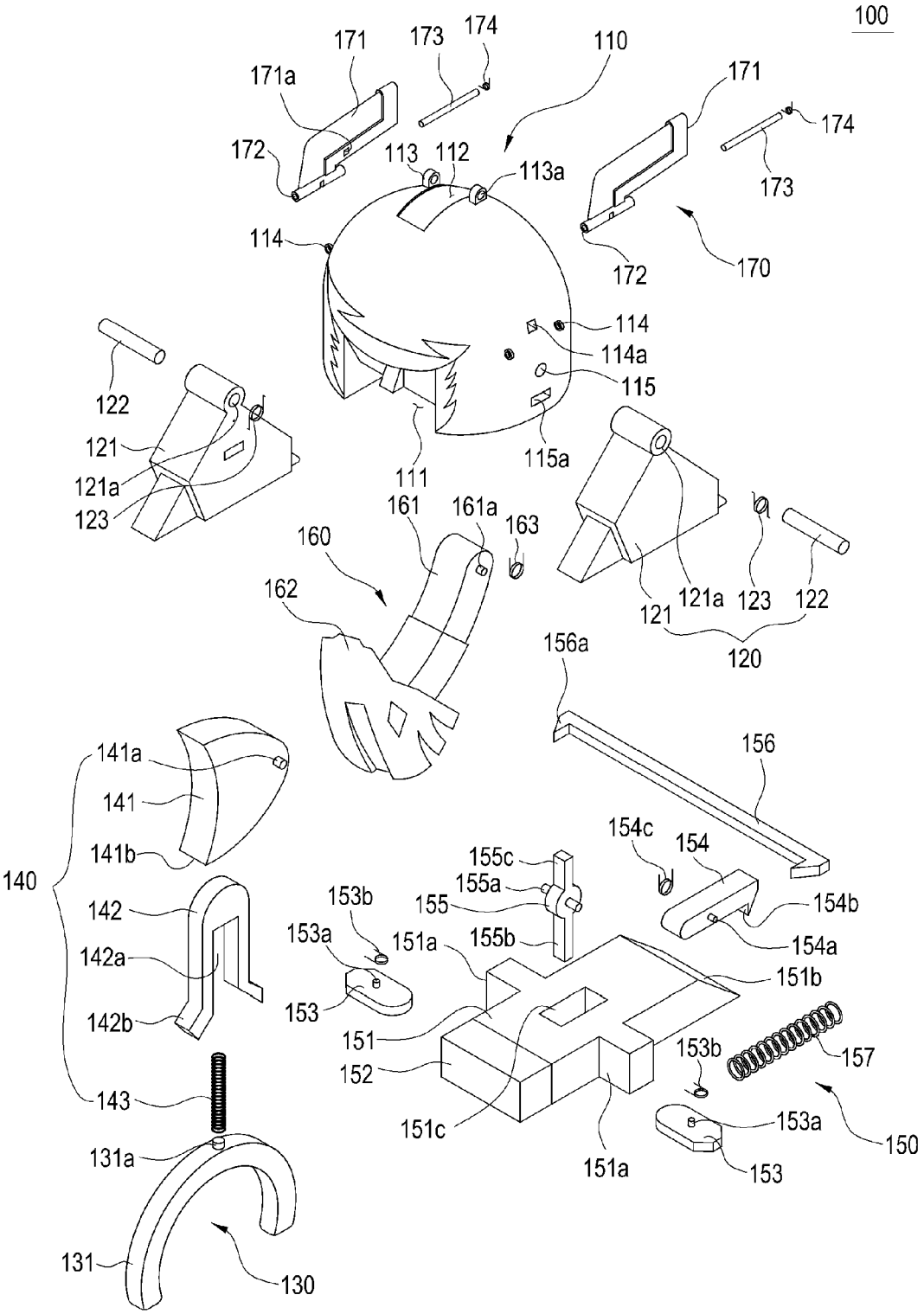
FIG. 2 is an exploded perspective view showing the shooting type toy of FIG. 1.
Figure 3:
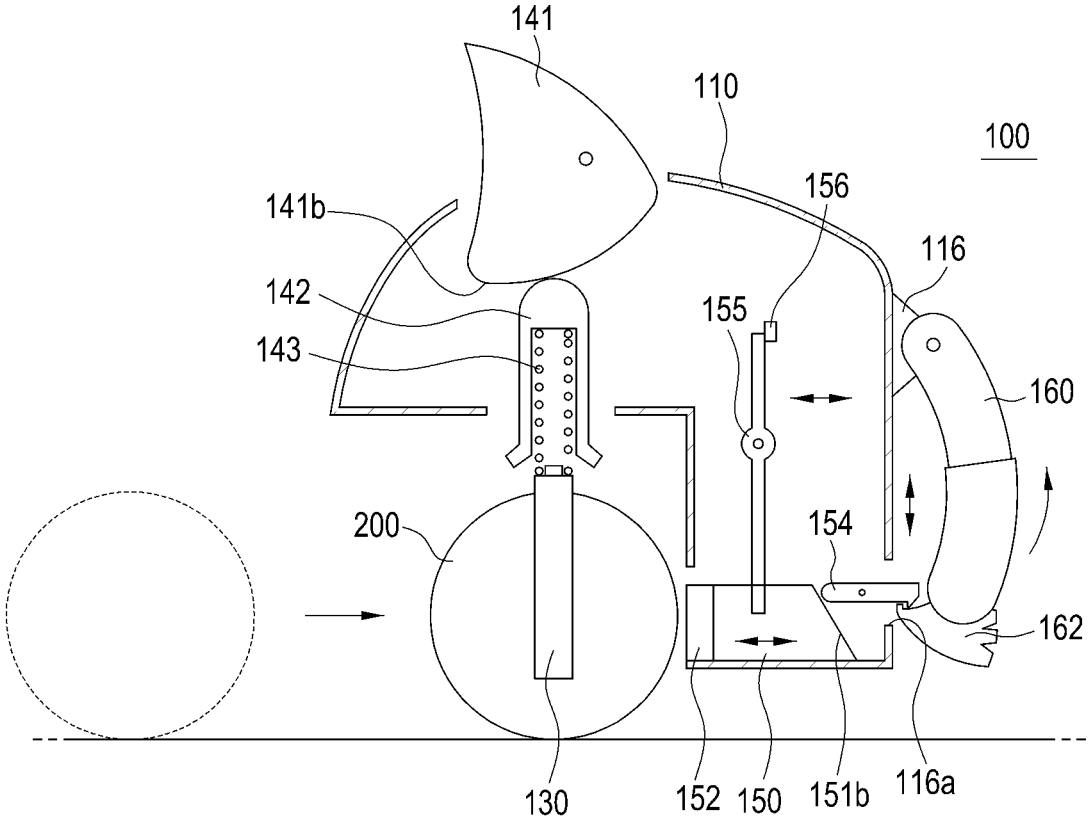
FIG. 3 is a side sectional view showing the shooting type toy of FIG. 1.
Figure 4:
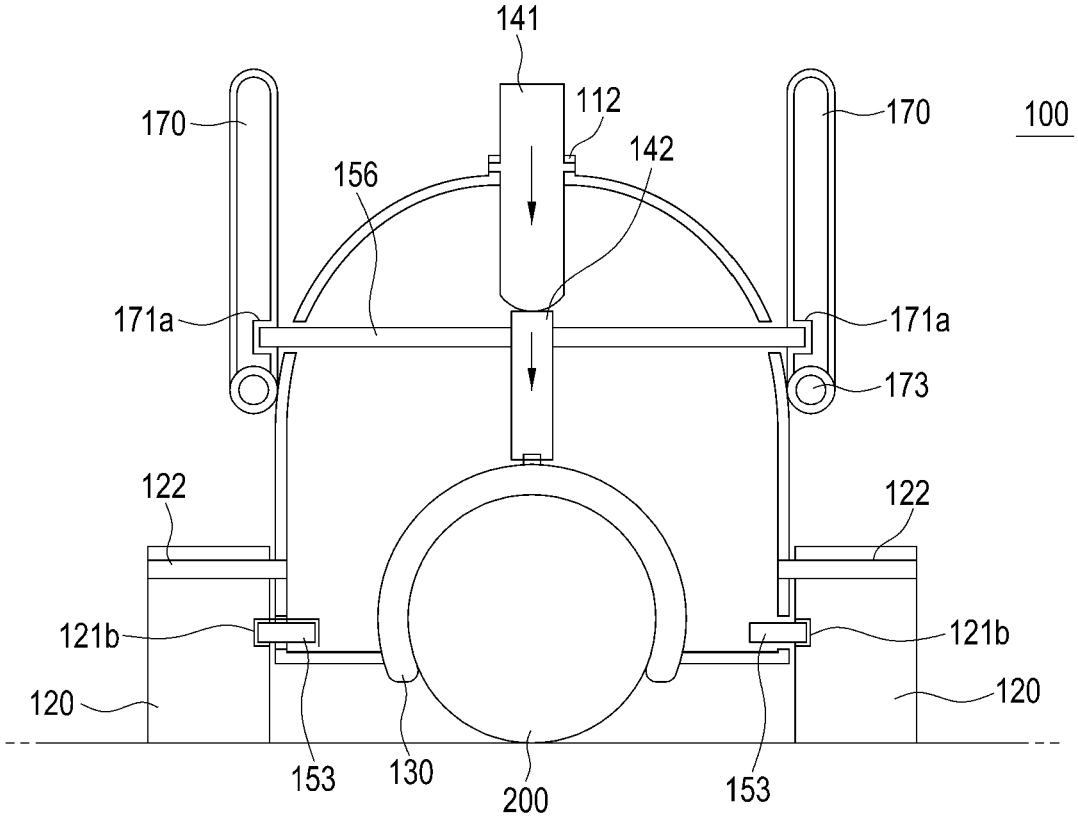
FIG. 4 is a front sectional view showing the shooting type toy of FIG. 1.
Figure 5:
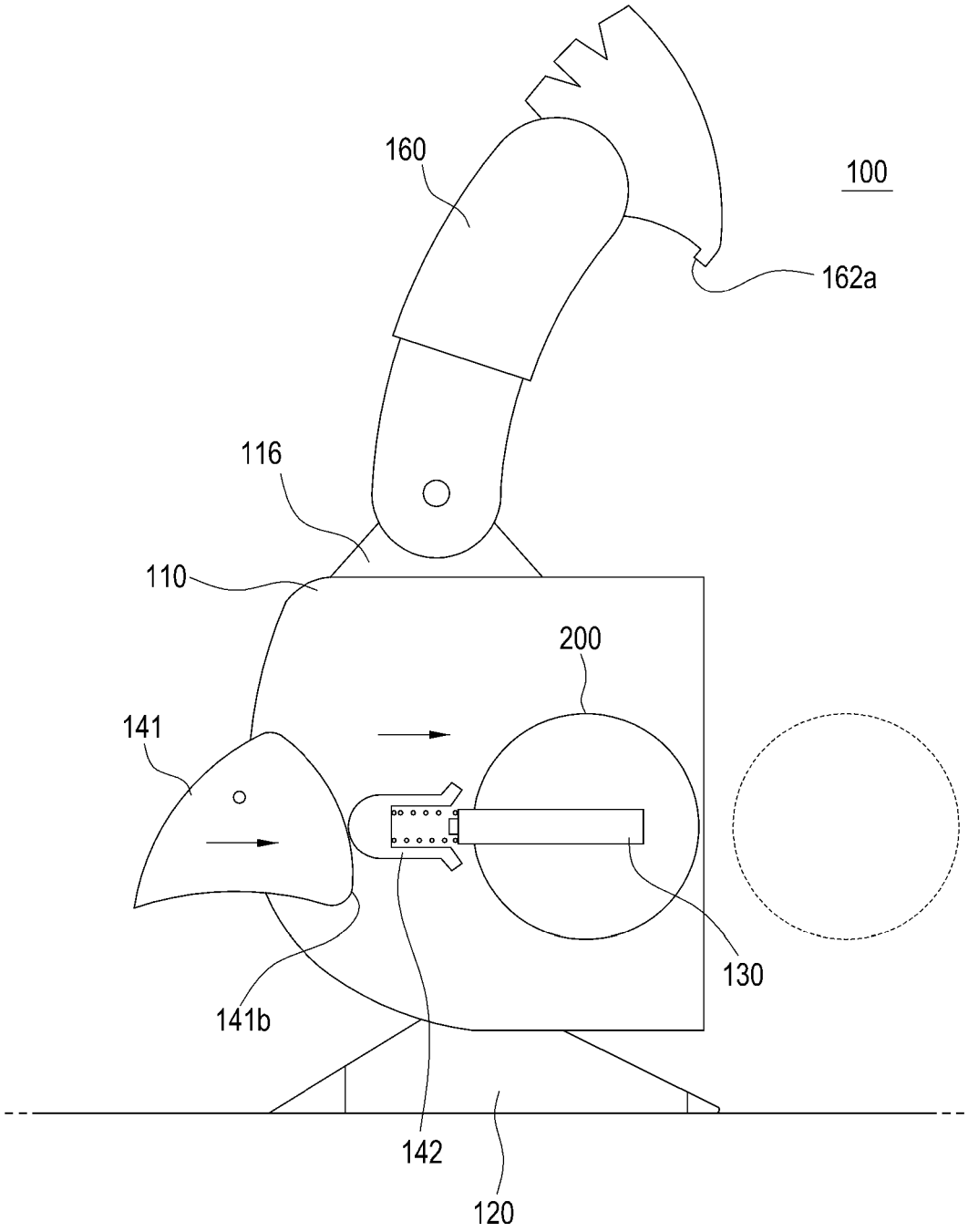
FIG. 5 is a side view showing a shooting process of the shooting type toy of FIG. 1.
Figure 6:
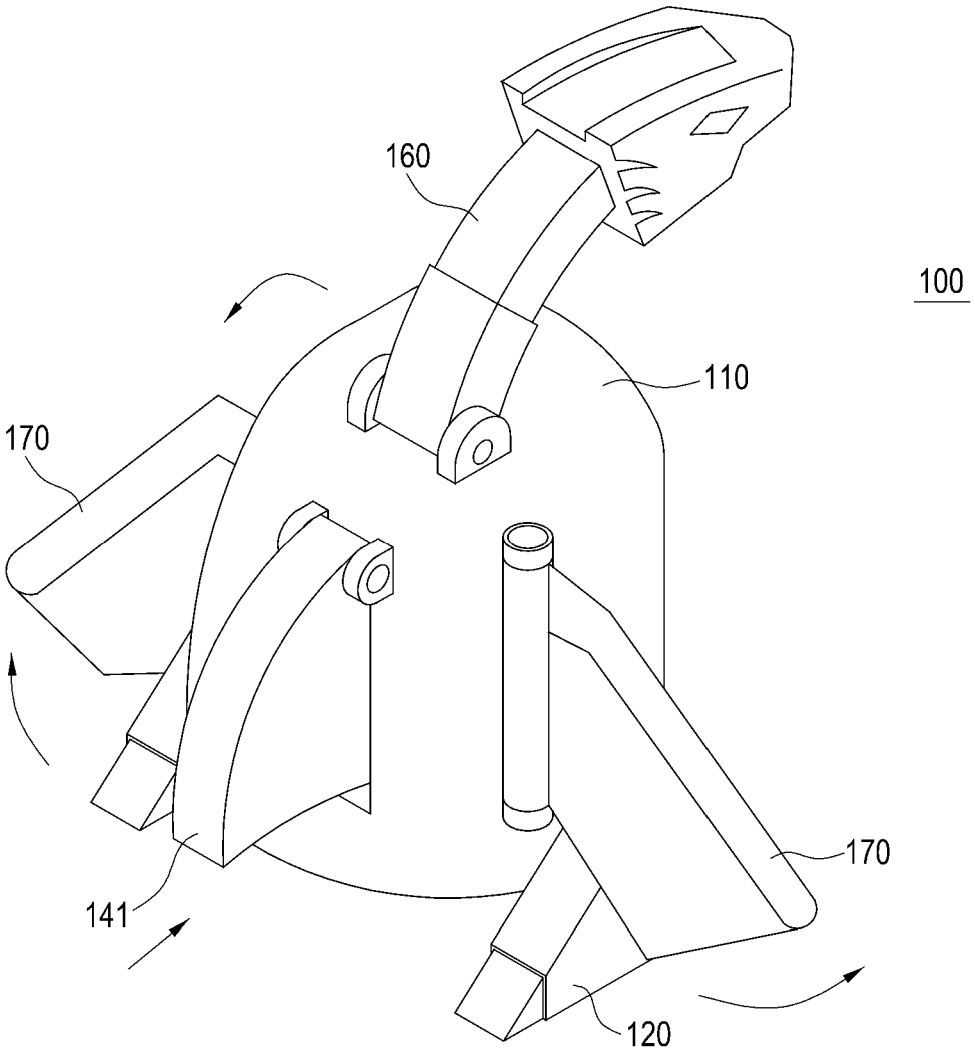
FIG. 6 is a perspective view showing an operation of the shooting type toy of FIG. 1.
Figure 7:
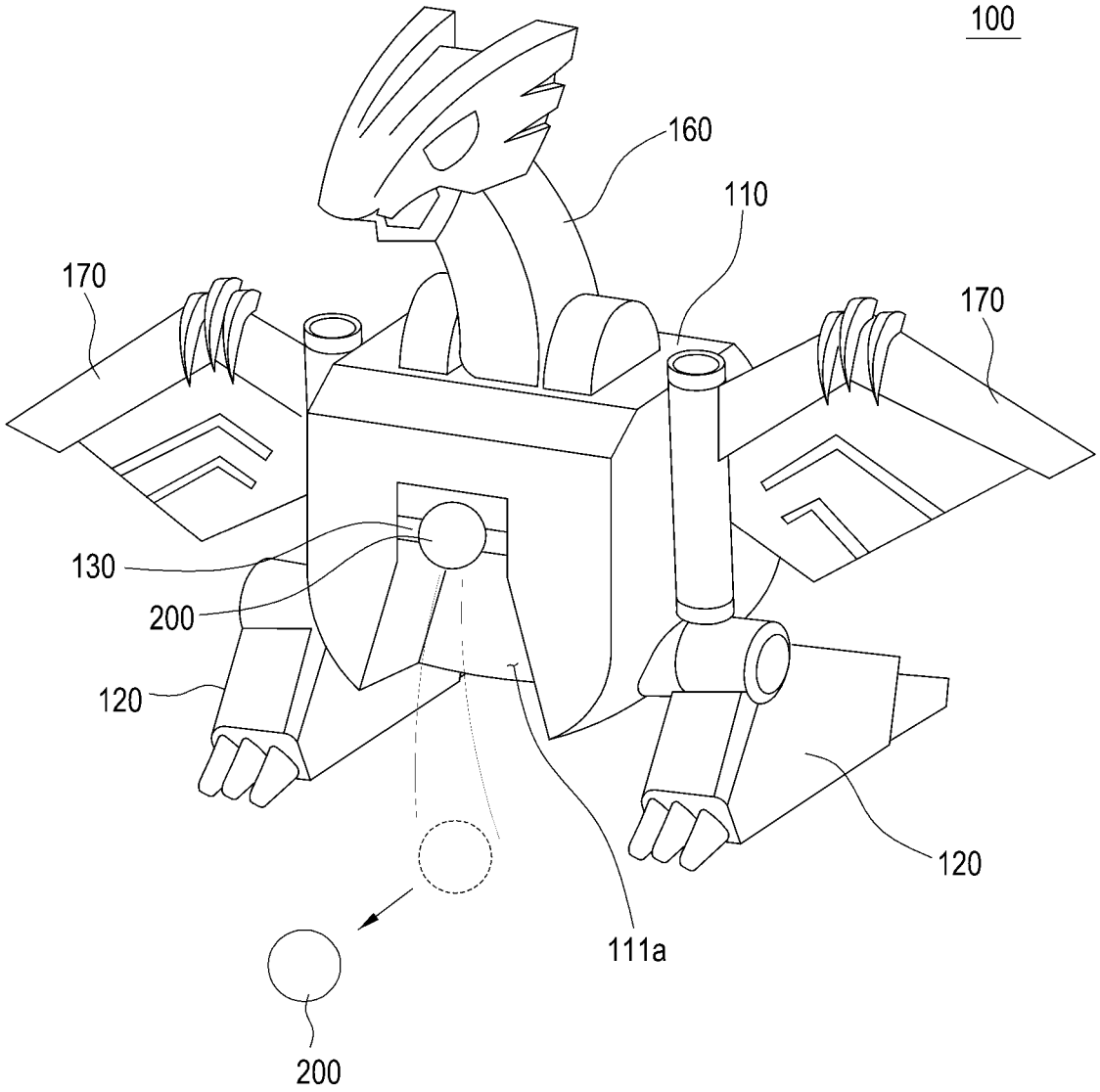
FIG. 7 is a perspective view showing a shooting operation of the shooting type toy of FIG. 1.

FIG. 1 is a perspective view showing a shooting type toy according to a first embodiment of the present invention, FIG. 2 is an exploded perspective view showing the shooting type toy of FIG. 1, FIG. 3 is a side sectional view showing the shooting type toy of FIG. 1, FIG. 4 is a front sectional view showing the shooting type toy of FIG. 1, FIG. 5 is a side view showing a shooting process of the shooting type toy of FIG. 1, FIG. 6 is a perspective view showing an operation of the shooting type toy of FIG. 1, and FIG. 7 is a perspective view showing a shooting operation of the shooting type toy of FIG. 1.

As shown in FIGS. 1 to 7, a shooting type toy 100 according to a first embodiment of the present invention includes a body part 110, support parts 120, a shooting part 130, a pressurizing part 140, a latch part 150, a pop-up part 160, auxiliary pop-up parts 170, and a projectile 200, wherein the body part 110 having a plurality of members is lockedly set by the latch part 150 in such a manner as to be kept to a first form in an external form thereof, and if the projectile 200 moving from the outside is inserted into the body part 110 and is thus located on the shooting part 130, the projectile 200 releases the locking state of the latch part 150 to allow the external form of the body part 110 to developedly transform into a second form, and if the inserted projectile 200 is located on the shooting part 130 disposed in the body part 110, the projectile 200 is shot, by means of the pressurizing part 140, from the body part 110 transformed into the second form.

The shooting type toy 100 is located on a given position, and if the projectile 200 moving from the outside is accommodated into the shooting type toy 100, a locking state of the shooting type toy 100 is released through contact of the shooting type toy 100 with the projectile 200, thereby allowing the shooting type toy 100 to transform from the first form into the second form. The projectile 200 accommodated into the shooting type toy 100 is shot from the shooting type toy 100 which has transformed into the second form.

The body part 110 has an accommodation space formed at the inside thereof in such a manner as to locate the shooting part 130, the pressurizing part 140, and the latch part 150 therein and also serves to rotatably support the pop-up part 160 and the auxiliary pop-up parts 170 thereagainst. The body part 110 includes a body part housing 111, a lever through hole 112, first hinges 113, second hinges 114, support part coupling holes 115, and third hinges 116.

Further, the body part 110 has the first form having at least one selected from mask, combat helmet, shield, car, building, and object, animal's egg, and animal forms, and if the shooting type toy 100 transforms from the first form into the second form, the second form is at least one of an animal, robot, dinosaur, and given animation character forms.

The body part housing 111 is formed of a single member or a plurality of members coupled to each other.

Also, the body part housing 111 is hollow in an interior thereof to accommodate the shooting part 130, the pressurizing part 140, and the latch part 150 therein and is open on one side of bottom thereof to insert the projectile 200 into the body part 110. In this case, the body part housing 111 has a guide portion 111*a* adapted to guide a moving path of the projectile 200 inserted into one side open to the interior thereof.

Further, the body part housing 111 includes the lever through hole 112 formed to a rectangular shape on one side thereof in such a manner as to allow a portion of the pressurizing part 140 to protrude by a given length outwardly from top of one side thereof, third locking member through holes 114*a* passing through portions of a third locking member 156, first locking member through holes 115*a* passing through portions of first locking members 153, and a second locking member through hole 116*a* passing through a portion of a second locking member 154.

The first hinges 113 are disposed on both sides of the lever through hole 112 in such a manner as to have through holes 113*a* formed thereon to allow a portion of the pressurizing part 140 protruding outwardly from the body part housing 111 to be rotatably supported thereagainst.

The second hinges 114 have through holes formed thereon in such a manner as to be disposed on both sides of the body part housing 111 to allow the auxiliary pop-up parts 170 to be rotatably supported thereagainst in axial directions thereof.

The support part coupling holes 115 are pierced into both sides of the body part housing 111 in such a manner as to allow rotary shafts 122 of the support parts 120 to be insertedly fitted thereto.

The third hinges 116 are disposed on one side of the body part housing 111 in such a manner as to allow the pop-up part 160 to be rotatably supported thereagainst in axial directions thereof.

The support parts 120 are disposed on both sides of the body part 110 in such a manner as to allow their undersides to come into close contact with the floor, and if the latch part 150 is released from the locking state thereof by means of the projectile 200, the support parts 120 serve to support the body part 110 thereagainst to allow the body part 110 to be rotated and displaced, so that the external form of the shooting type toy 100 transforms from the first form into the second form. To this end, each support part 120 includes a support part body 121, the rotary shaft 122, and a support part spring 123.

The support part body 121 comes into close contact with the floor to allow the body part 110 to be seated onto the floor and includes a through hole 121*a* to which the rotary shaft 122 is fitted and a first locking member fixing groove 121*b* for lockedly fitting the corresponding first locking member 153 thereto.

The rotary shaft 122 is coupled to the body part 110 through the corresponding support part coupling hole 115 to support the body part 110 thereagainst, so that the body part 110 rotates in an axial direction of the support part body 121.

The support part spring 123 provides an elastic force to allow the body part 110 to rotate around the rotary shaft 122 if the locking state between the body part 110 and the support part 120 is released to separate the corresponding first locking member 153 from the corresponding first locking member fixing groove 121*b*.

Each support part 120 has a plurality of wheels (not shown) mounted on the underside thereof, so that if the shooting type toy 100 pushes by the user toward a given direction, the support part 120 can be driven.

The shooting part 130 is disposed in the body part 110 and is formed of an arch-shaped elastic body having a section of '∩' in such a manner as to be open on one side thereof. The shooting part 130 includes a shooting part body 131 adapted to allow the inserted projectile 200 to be seated onto the inner periphery thereof, so that the seated projectile 200 is shot to one side open thereof by means of an elastic force of the shooting part 130 itself.

The pressurizing part 140 is disposed in the body part 110 and serves to move the projectile 200 to the open front end of the shooting part 130 to pressurize the projectile 200 thereagainst so that the projectile 200 is shot through the elastic force of the shooting part 130. The pressurizing part 140 includes a lever 141, a firing pin 142, a firing pin spring 143.

The lever 141 is pressurized by the user so as to shoot the projectile 200, and it is rotatably coupled to the first hinges 113 through rotary shafts 141*a* formed on one side thereof. Also, the lever 141 protrudes outwardly from the body part 110 through the lever through hole 112 and has a cam 141*b* formed on the other side thereof to pressurize the firing pin 142 thereagainst so that while the lever 141 rotates around the rotary shafts 141*a*, the firing pin 142 moves horizontally.

The firing pin 142 is connected to the cam 141*b* of the lever 141 on one side thereof, and, if the lever 141 operates, it moves horizontally to allow projectile contact portions 142*b* formed on the other side end thereof to pressurize the projectile 200 thereagainst.

Further, the firing pin 142 has a firing pin insertion groove 142*a* open on one side of a firing pin body in a longitudinal direction of the firing pin body to allow the firing pin spring 143 to be disposed therein, thereby preventing collision with the shooting part 130 while the firing pin 142 is moving.

The firing pin spring 143 is connected to a shooting part protrusion 131*a* of the shooting part body 131 on one side thereof and is insertedly disposed in the firing pin insertion groove 142*a* on the other side thereof to provide an elastic force for the firing pin 142 so that the firing pin 142 is kept to a given position.

The latch part 150 is disposed in the body part 110 and is displaced to a locking position or a locking releasing position by means of the projectile 200. The latch part 150 includes a latch part body 151, a latch actuator 152, the first locking members 153, the second locking member 154, a link 155, the third locking member 156, and a latch part spring 157.

The latch part body 151 is disposed under the body part 110 and moves horizontally by means of the projectile 200 to release the first to third locking members 153, 154 and 156 from locking states. To this end, the latch part body 151 includes first contact portions 151*a*, a second contact portion 151*b*, and a third contact portion 151*c*.

The first contact portions 151*a* protrude by given lengths from both side surfaces of the latch part body 151 and operate to allow the first locking members 153 to be displaced to the locking position or the locking releasing position.

That is, each first contact portion 151*a* comes into contact with the end of the corresponding first locking member 153, and if the latch part body 151 moves horizontally, each first contact portion 151*a* is interlocked with one side end of the corresponding first locking member 153 to allow the other side end of the corresponding first locking member 153 to rotate around a first locking member rotary shaft 153*a* of the corresponding first locking member 153.

The second contact portion 151*b* is formed on one side of the latch part body 151 and serves to allow the second locking member 154 to be displaced to the locking position or the locking releasing position. The second contact portion 151*b* has an inclined surface having a given angle.

In detail, the inclined surface of the second contact portion 151*b* comes into contact with the end of the second locking member 154, and if the latch part body 151 moves horizontally, the end of the second locking member 154 is displaced along the inclined surface of the second contact portion 151*b* to allow the second locking member 154 to operate vertically.

The third contact portion 151*c* passes through the latch part body 151 in such a manner as to be interlocked with the link 155, and if the latch part body 151 moves horizontally, the third contact portion 151*c* operates the link 155 to allow the third locking member 156 to move horizontally.

The latch actuator 152 is disposed on the other side of the latch part body 151 and forms an attractive force caused by a magnetic field together with the projectile 200 to provide a driving force so that the latch part body 151 is displaced horizontally. Desirably, the latch actuator 152 is formed of a magnet.

Each first locking member 153 comes into contact with the corresponding first contact portion 151*a* on one side thereof and is interlocked with the corresponding first locking member fixing groove 121*b* of the support part 120 through the first locking member through hole 115*a* on the other side thereof, so that each first locking member 153 rotates around the first locking member rotary shaft 153*a* according to the displacement of the latch part body 151.

The second locking member 154 comes into contact with the inclined surface of the second contact portion 151*b* on one side thereof and is interlocked with a second locking member fixing groove 162*a* of the pop-up part 160 through the second locking member through hole 116*a* on the other side thereof, so that the second locking member 154 rotates around a second locking member rotary shaft 154*a* to separate a locking protrusion 154*b* from the pop-up part 160 according to the displacement of the latch part body 151.

The second locking member 154 further includes a second locking member spring 154*c* for providing an elastic force to allow the locking protrusion 154*b* to move downwardly if the latch part 150 is displaced horizontally and thus moves to the locking releasing position.

The link 155 has rotary shafts 155*a* disposed on both sides thereof so that it rotates according to the displacement of the latch part body 151, and further, the link 155 includes a first protrusion 155*b* extended by a given length from one side thereof in such a manner as to be coupled to the third contact portion 151*c* of the latch part body 151 and a second protrusion 155*c* extended by a given length from the other side thereof in such a manner as to be interlocked with the third locking member 156.

The third locking member 156 has locking protrusions 156*a* formed on both side end portions thereof, and the locking protrusions 156*a* pass through the third locking member through holes 114*b* in such a manner as to be interlocked with third locking member fixing grooves 171*a* of the auxiliary pop-up parts 170.

Further, the third locking member 156 is connected to the second protrusion 155*c* of the link 155 so that it is fixed to or separated from the auxiliary pop-up parts 170 according to an operation of the link 155.

The latch part spring 157 is disposed on one side of the latch part body 151 to provide an elastic force for the latch part body 151 so that the latch part body 151 is kept to a given position.

If the projectile 200 is shot after the latch part body 151 has been displaced and moved by the attractive force between the latch actuator 152 and the projectile 200, in detail, the latch part spring 157 returns the latch part body 151 to its original position.

The pop-up part 160 is rotatably coupled to the body part 110 by means of the third hinges 116, and if the latch part 150 is released from the locking state thereof, the pop-up part 160 is developed from the body part 110 to allow the external form of the shooting type toy 100 to transform from the first form into the second form. So as to perform the separating and developing operations from the body part 110 in more active manner, the pop-up part 160 includes a first pop-up part body 161, a second pop-up part body 162, and pop-up part springs 163. According to the first embodiment of the present invention, the pop-up part 160 has a form of a head.

The first pop-up part body 161 has rotary shafts 161*a* disposed on one side thereof in such a manner as to be coupled to the third hinges 116 and is connected to the second pop-up part body 162 on the other side thereof.

The second pop-up part body 162 is coupled to the first pop-up part body 161 on one side thereof and to the second locking member 154 through the second locking member fixing groove 162*a* on the other side thereof in such a manner as to be fixedly kept to the body part 110.

According to the first embodiment of the present invention, the pop-up part 160 has the first pop-up part body 161 and the second pop-up part body 162 separable from each other, but it is not limited thereto. That is, the pop-up part 160 may be formed of a single body or three or more bodies.

The pop-up part springs 163 are fitted to the rotary shafts 161*a* of the first pop-up part body 161, and they provide elastic forces to allow the first pop-up part body 161 to rotate around the third hinges 116 if the second pop-up part body 162 is separated from the second locking member 154.

The auxiliary pop-up parts 170 are rotatably coupled to the body part 110 through the second hinges 114 and are developed from the body part 110 if the latch part 150 is released from the locking state thereof, so that the external form of the shooting type toy 100 transforms from the first form into the second form. Each auxiliary pop-up part 170 includes an auxiliary pop-up part body 171, an auxiliary pop-up part hinge 172, a rotary shaft 173, and an auxiliary pop-up part spring 174.

The auxiliary pop-up part body 171 is a member having a shape of a wing and has a third locking member fixing groove 171*a* interlocked with the third locking member 156. The auxiliary pop-up part body 171 is coupled to the auxiliary pop-up part hinge 172 on one side end thereof.

The auxiliary pop-up part hinge 172 is coupled to the corresponding second hinges 114 through the rotary shaft 173 to allow the auxiliary pop-up part body 171 to rotate around the axial direction of the second hinges 114.

The auxiliary pop-up part spring 174 is fitted to the rotary shaft 173 and provides an elastic force to allow the auxiliary pop-up part body 171 to rotate around the second hinges 114 if the auxiliary pop-up part body 171 is separated from the third locking member 156.

The projectile 200 is moved manually by the user's force or is shot and moved from a given shooting device and has various forms such as a spherical, circular, polyhedral, and polygonal forms. Otherwise, the projectile 200 is made of a magnetic material like iron to form a magnetic field together with the latch actuator 152 of the latch part 150 made of the magnet, or has a magnetic material contained therein.

That is, if the projectile 200 has an external form made of a non-magnetic material like plastic resin, the projectile 200 has a member made of a metal material disposed therein to form a magnetic field therefrom.

Further, if the projectile 200 is made of the non-magnetic material, it has light emitting means (not shown) disposed therein to emit light therefrom, thereby increasing visual effects.

Furthermore, if the projectile 200 is made of the non-magnetic material, it has at least one member selected from animal, object, characters, numbers, figures, and animation character disposed in an interior thereof, thereby being utilized as various game tools.

Next, an explanation on an operation of the shooting type toy 100 according to the first embodiment of the present invention will be given.

The pop-up part 160 and the auxiliary pop-up parts 170 are fixedly brought into contact with the body part 110, and the body part 110 fixedly rotates around the rotary shafts 122 of the support parts 120, so that the external form of the shooting type toy 100 is kept to the first form.

The shooting type toy 100 kept to the first form is located at an arbitrary position, and the projectile 200 moves to the shooting type toy 100 by means of the user.

The projectile 200 is inserted into one side open of the body part 110 and moves along the guide portion 111*a*, and if the projectile 200 is located in the shooting part 130 disposed in the interior of the body part 110, an attractive force between the latch actuator 152 of the latch part 150 and the projectile 200 is generated by the magnetic field to allow the latch part 150 to move toward the projectile 200.

If the latch part 150 moves to a left side in FIG. 3 by means of the attractive force caused by the magnetic field, the first to third contact portions 151*a*, 151*b* and 151*c* of the latch part 150 also move to the left side, so that the first locking members 153, the second locking member 154, and the third locking member 156 operating cooperatively with the link 155 are displaced from the locking positions to the locking releasing positions.

If the positions of the first to third locking members 153, 154 and 156 are displaced, the body part 110, the pop-up part 160 and the auxiliary pop-up parts 170, which are fixedly interlocked with the first to third locking members 153, 154 and 156, are rotatingly developed, so that the external form of the shooting type toy 100 transforms from the first form into the second form.

In detail, if the first locking members 153 are released from the locking states thereof, as shown in FIG. 5, the body part 110 rotates around the rotary shafts 122 of the support parts 120 by means of the elastic forces of the support part springs 123, and if the second locking member 154 is released from the locking state thereof, the pop-up part 160 rotates around the third hinges 116 by means of the elastic forces of the pop-up part springs 163. Further, if the third locking member 156 is released from the locking state thereof, the auxiliary pop-up parts 170 developedly rotate around the second hinges 114 by means of the elastic forces of the auxiliary pop-up part springs 174.

On the other hand, if the shooting type toy 100 transforms into the second form by means of the projectile 200, the inserted projectile 200 is restrained in the state of being seated onto the shooting part 130 by means of the magnetic force made together with the latch actuator 152, and further, as shown in FIG. 4, the shooting part 130 restrains the projectile 200 thereinto in a horizontal direction at a position of ⅔ of the circumstance of the projectile 200.

If the lever 141 of the pressurizing part 140 is pressed by the user, it rotates around the first hinges 113, and the cam 141*b* formed on one side of the lever 141 pressurizes the firing pin 142 thereagainst to allow the firing pin 142 to move horizontally.

If the firing pin 142 moves horizontally to pressurize the projectile 200 thereagainst, both side ends open of the shooting part 130 restraining the projectile 200 thereinto are open to allow the projectile 200 to be shot by means of the elastic force of the shooting part 130.

Accordingly, if the projectile moving from the outside is inserted into the shooting type toy, the shooting type toy transforms from the first form into the second form, and the inserted projectile is loaded in the shooting type toy and then shot from the shooting type toy, thereby more increasing funs in shooting play.

Second Embodiment

Figure 8:
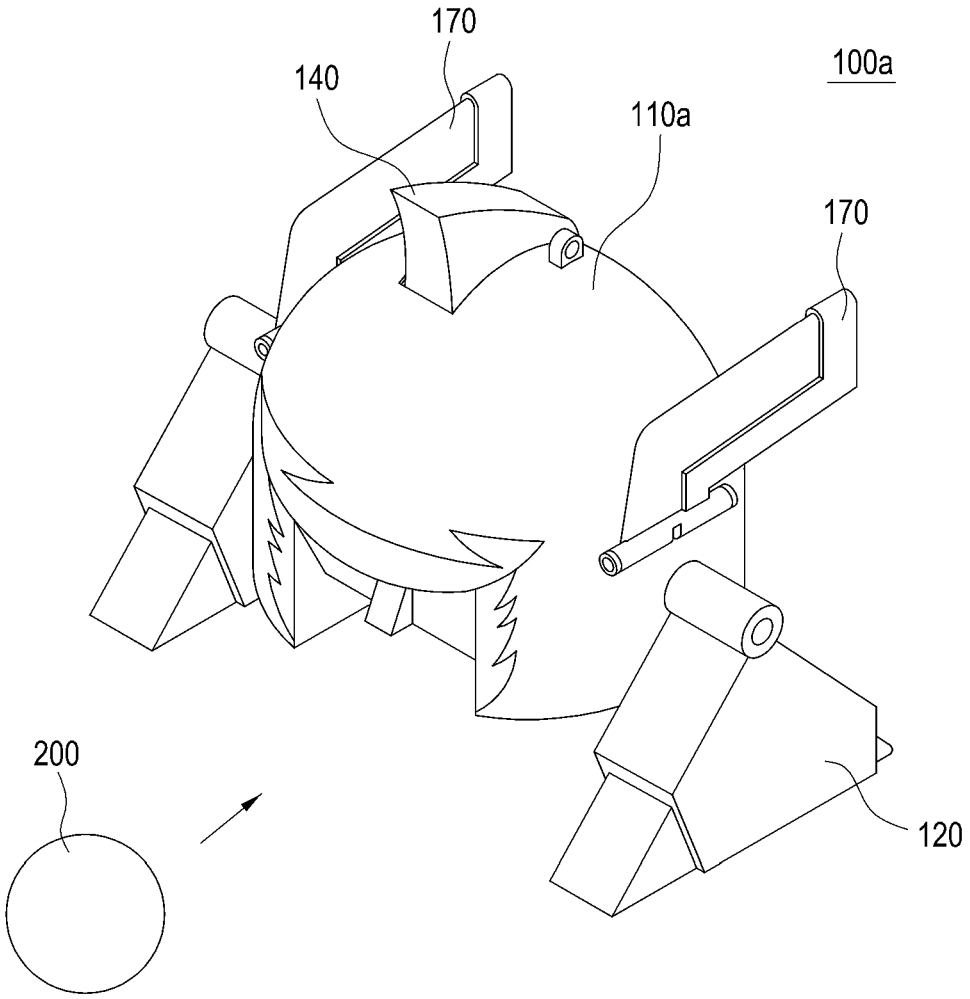
FIG. 8 is a perspective view showing a shooting type toy according to a second embodiment of the present invention.
Figure 9:
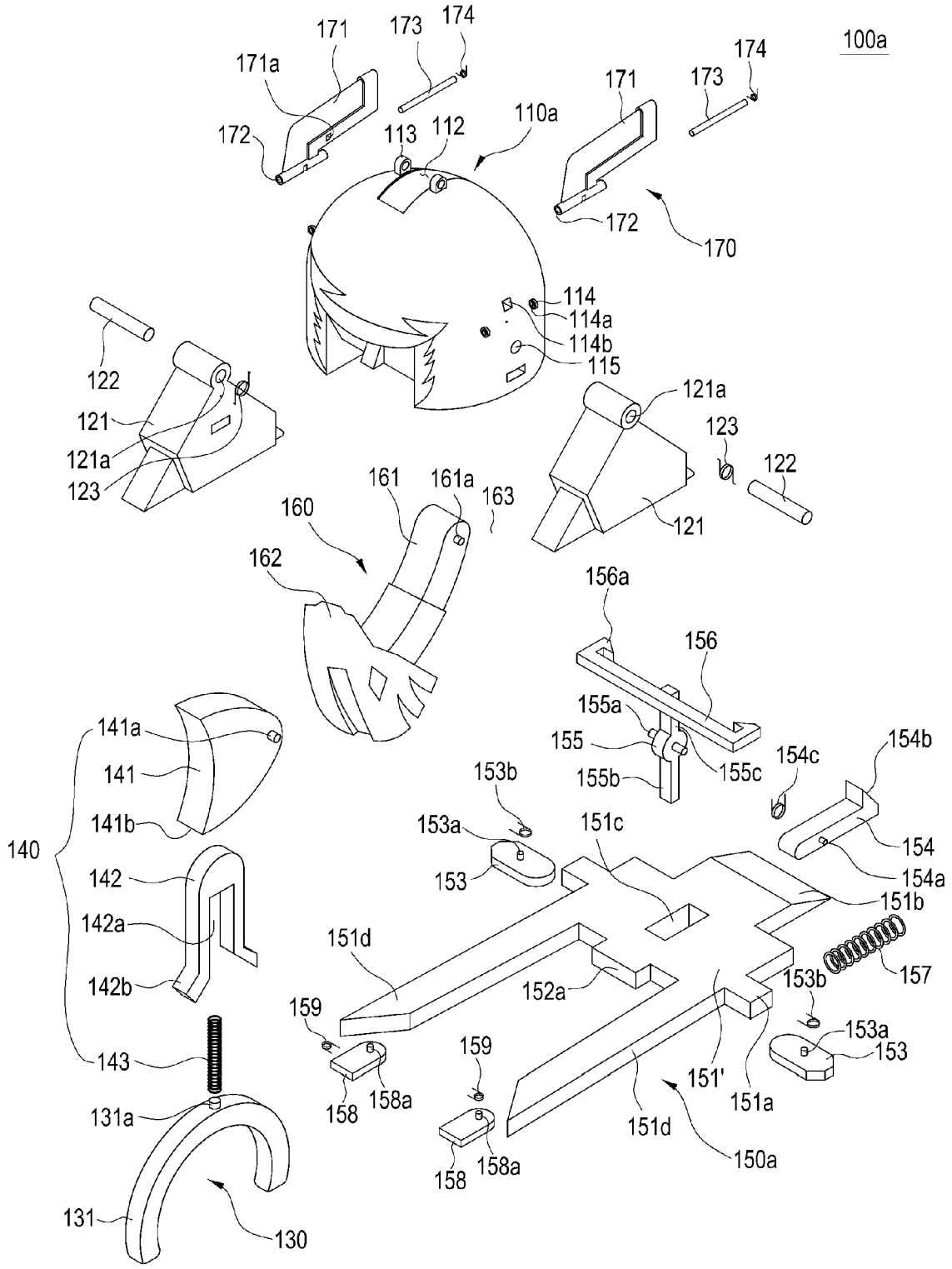
FIG. 9 is an exploded perspective view showing the shooting type toy of FIG. 8.
Figure 10:
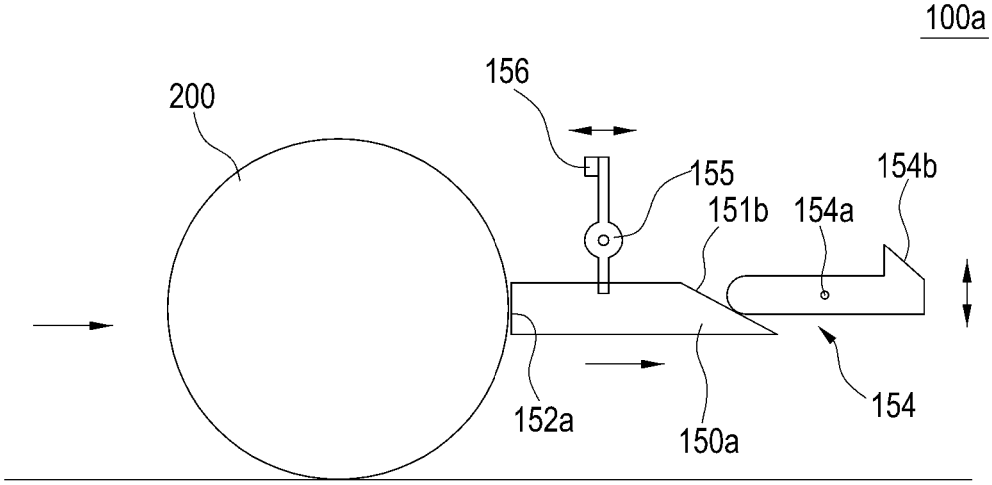
FIG. 10 is a side view showing an operation of the shooting type toy of FIG. 8.
Figure 11:
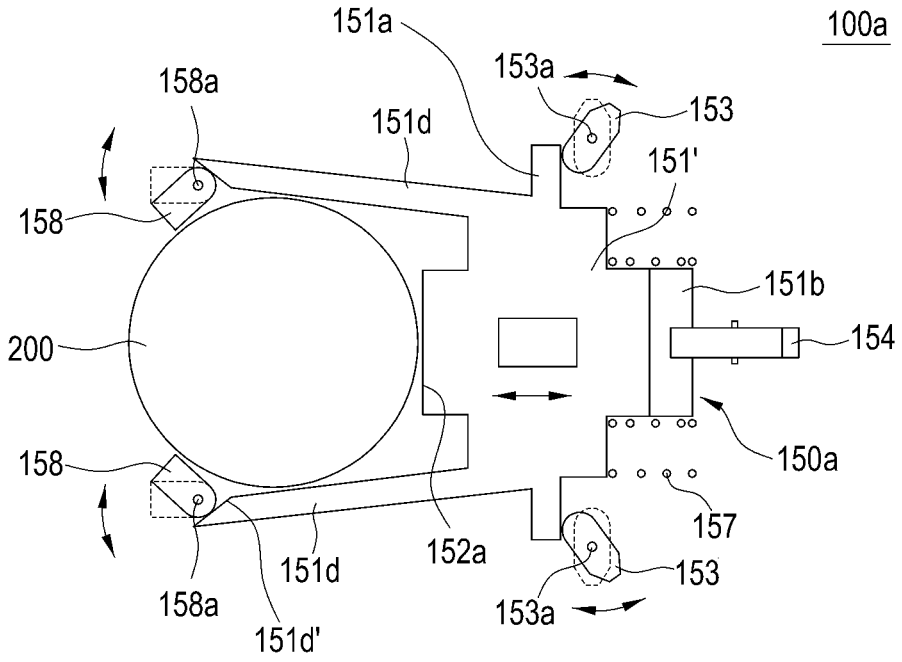
FIG. 11 is a side view showing another operation of the shooting type toy of FIG. 8.
Figure 12:
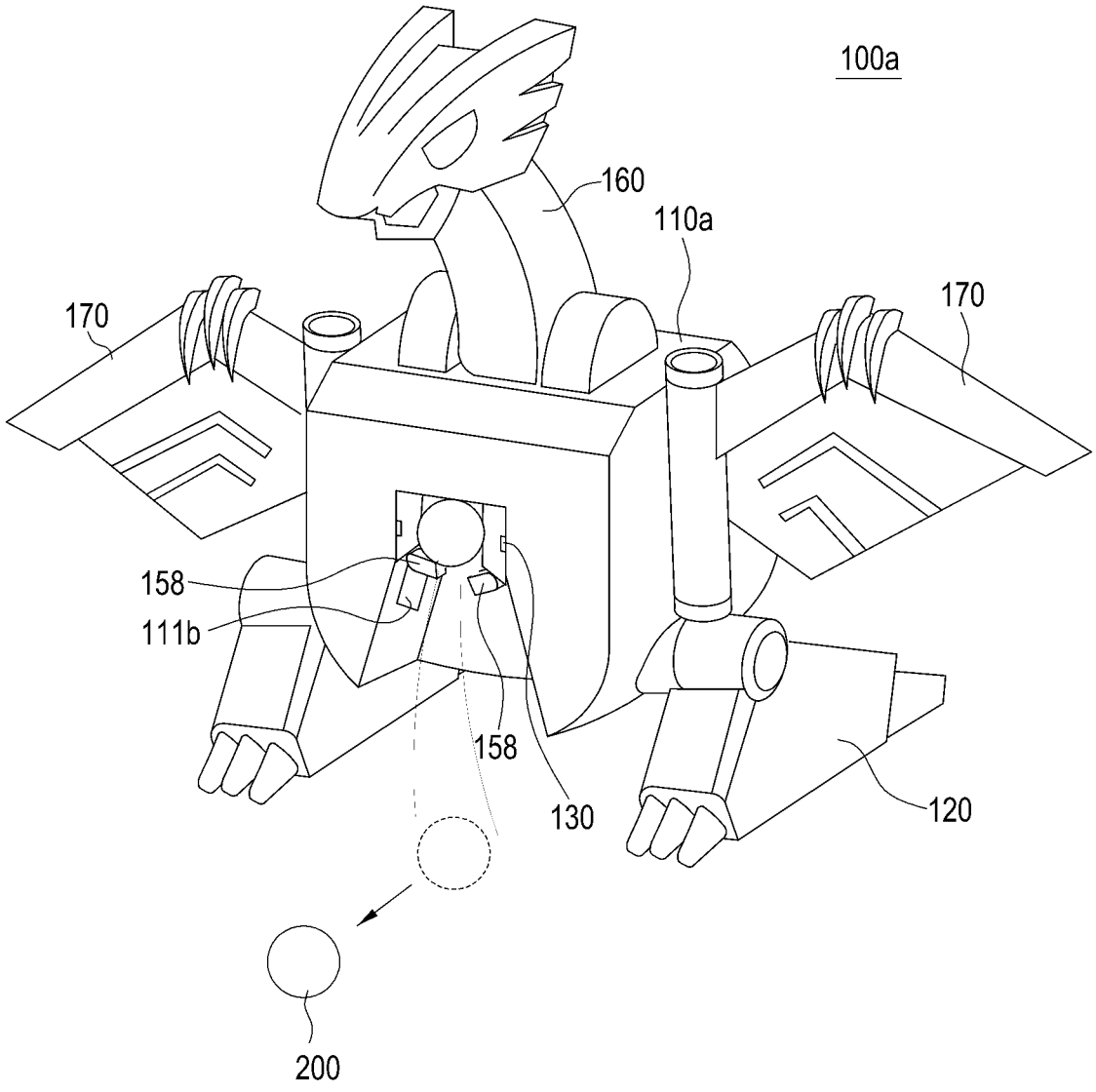
FIG. 12 is a side view showing a shooting operation of the shooting type toy of FIG. 8.

FIG. 8 is a perspective view showing a shooting type toy according to a second embodiment of the present invention, FIG. 9 is an exploded perspective view showing the shooting type toy of FIG. 8, FIG. 10 is a side view showing an operation of the shooting type toy of FIG. 8, FIG. 11 is a side view showing another operation of the shooting type toy of FIG. 8, and FIG. 12 is a side view showing a shooting operation of the shooting type toy of FIG. 8.

First, the repeated explanation on the same parts as in the first embodiment of the present invention will be avoided, and the same reference numerals will be used to describe the same components.

As shown in FIGS. 8 to 12, a shooting type toy 100*a* according to a second embodiment of the present invention includes a body part 110*a*, support parts 120, a shooting part 130, a pressurizing part 140, a latch part 150*a*, a pop-up part 160, auxiliary pop-up parts 170, and a projectile 200, wherein the body part 110*a* is lockedly set by the latch part 150*a* in such a manner as to be kept to a first form in an external form thereof, and if the projectile 200 moving from the outside is inserted into the body part 110 to release a locking state of the latch part 150*a*, the body part 110*a* is developed to allow the external form thereof to transform into a second form from the first form. After that, the inserted projectile 200 is restrained into the shooting part 130 disposed in the body part 110*a*, and if the projectile 200 is pressurized against the pressurizing part 140, the projectile 200 is shot from the body part 110*a* by means of a restraining force applied to the shooting part 130.

According to the second embodiment of the present invention, the shooting type toy 100*a* is configured to allow the latch part 150*a* to operate through physical contact with the projectile 200, which is different from the shooting type toy 100 according to the first embodiment of the present invention that is configured to allow the latch part 150 to operate through the attractive force caused by the magnetic field made together with the projectile 200.

According to the second embodiment of the present invention, in detail, the projectile 200 of the shooting type toy 100*a* is made of a non-magnetic material, and even though the projectile 200 is made of a magnetic material, the latch part 150*a* operates through the physical contact with the projectile 200.

The body part 110*a* has an accommodation space formed at the inside thereof in such a manner as to locate the shooting part 130, the pressurizing part 140, and the latch part 150*a* therein and also serves to rotatably support the pop-up part 160 and the auxiliary pop-up parts 170.

Further, the body part 110*a* is formed of a single member or a plurality of members coupled to each other and has at least one external form selected from mask, combat helmet, shield, car, building, and object, and animal's egg forms. The body part 110*a* includes a body part housing 111, a lever through hole 112, first hinges 113, second hinges 114, support part coupling holes 115, and third hinges 116.

Also, the body part housing 111 is hollow in an interior thereof to accommodate the shooting part 130, the pressurizing part 140, and the latch part 150*a* therein and is open on one side of bottom thereof to insert the projectile 200 into the body part 110*a*. In this case, the body part housing 111 has a guide portion 111*a* adapted to guide a moving path of the projectile 200 inserted into one side open to the interior thereof and fixing member installation grooves 111*b* formed on the guide portion 111*a* to install projectile fixing members 158 therein.

The latch part 150*a* is disposed in the body part 110*a* and is displaced to a locking position or a locking releasing position by means of the projectile 200. The latch part 150*a* includes a latch part body 151', a latch actuator 152*a*, first locking members 153, a second locking member 154, a link 155, a third locking member 156, a latch part spring 157, the projectile fixing members 158, and fixing member springs 159.

The latch part body 151' is disposed under the body part 110*a* and moves horizontally by means of the projectile 200 to release the first to third locking members 153, 154 and 156 from locking states and also to allow the projectile fixing members 158 to be locked from locking releasing. To this end, the latch part body 151' includes first contact portions 151*a*, a second contact portion 151*b*, a third contact portion 151*c*, and fourth contact portions 151*d*.

The fourth contact portions 151*d* are formed on the other side of the latch part body 151' to allow the projectile fixing members 158 to be displaced to locking positions or locking releasing positions, and they have inclined surfaces having given angles formed on the ends thereof.

In detail, the inclined surfaces of the fourth contact portions 151*d* come into contact with the ends of the projectile fixing members 158, and if the latch part body 151' moves horizontally, the ends of the projectile fixing members 158 are displaced along the inclined surfaces of the fourth contact portions 151*d* to allow the projectile fixing members 158 to rotate around rotary shafts 158*a*.

The latch actuator 152*a* is disposed on the other side of the latch part body 151' to horizontally displace the latch part body 151' through the physical contact with the projectile 200, and so as to move the latch part body 151' by a given distance through the collision with the projectile 200, the latch actuator 152*a* is formed of a protrusion protruding from the latch part body 151'.

The projectile fixing members 158 come into contact with the inclined surfaces of the fourth contact portions 151*d* on one side thereof and are exposed to the outside through the fixing member installation grooves 111*b* on the other side thereof in such a manner as to come into close contact with the projectile 200, so that according to the displacement of the latch part body 151', the projectile fixing members 158 rotate around the rotary shafts 158*a* and are contacted with or separated from the projectile 200.

The fixing member springs 159 are fitted to the rotary shafts 158*a* of the projectile fixing members 158 to provide elastic forces for the projectile fixing members 158 so that the projectile fixing members 158 are kept to given positions.

Next, an explanation on an operation of the shooting type toy 100*a* according to the second embodiment of the present invention will be given.

The pop-up part 160 and the auxiliary pop-up parts 170 are fixedly brought into contact with the body part 110*a*, and the body part 110*a* fixedly rotates around the rotary shafts 122 of the support parts 120, so that the external form of the shooting type toy 100 is kept to the first form.

The shooting type toy 100*a* kept to the first form is located at an arbitrary position, and the projectile 200 is shot by a user and moves to the shooting type toy 100*a*.

The projectile 200 is inserted into one side open of the body part 110*a* and moves along the guide portion 111*a*, and if the projectile 200 is located in the shooting part 130 disposed in the interior of the body part 110*a*, the latch actuator 152*a* of the latch part 150*a* moves in the moving direction of the projectile 200 through the physical contact and collision with the projectile 200.

If the latch part 150*a* moves, the first to fourth contact portions 151*a*, 151*b*, 151*c* and 151*d* of the latch part 150*a* also move, so that the first locking members 153, the second locking member 154, and the third locking member 156 operating cooperatively with the link 155 are displaced from the locking positions to the locking releasing positions and the projectile fixing members 158 come into close contact with the projectile 200 in such a manner as to be fixed to the shooting part 130.

If the positions of the first to third locking members 153, 154 and 156 are displaced, the body part 110*a*, the pop-up part 160 and the auxiliary pop-up parts 170, which are fixedly interlocked with the first to third locking members 153, 154 and 156, rotate around the support parts 120 or are developed around the body part 110*a*, so that the external form of the shooting type toy 100*a* transforms from the first form into the second form.

On the other hand, if the shooting type toy 100*a* transforms into the second form by means of the projectile 200, the inserted projectile 200 is restrained in the state of being seated onto the shooting part 130 by means of the projectile fixing members 158.

After that, if the lever 141 of the pressurizing part 140 is pressed by the user, it rotates around the first hinges 113, and the cam 141*b* formed on one side of the lever 141 pressurizes the firing pin 142 thereagainst to allow the firing pin 142 to move horizontally, so that the projectile 200 is shot by means of the elastic force of the shooting part 130.

Accordingly, if the projectile made of the non-magnetic material moving from the outside is inserted into the shooting type toy, the shooting type toy transforms from the first form into the second form. Next, the inserted projectile is fixed to the shooting type toy by means of the projectile fixing members and is then shot from the shooting type toy.

Third Embodiment

Figure 13:
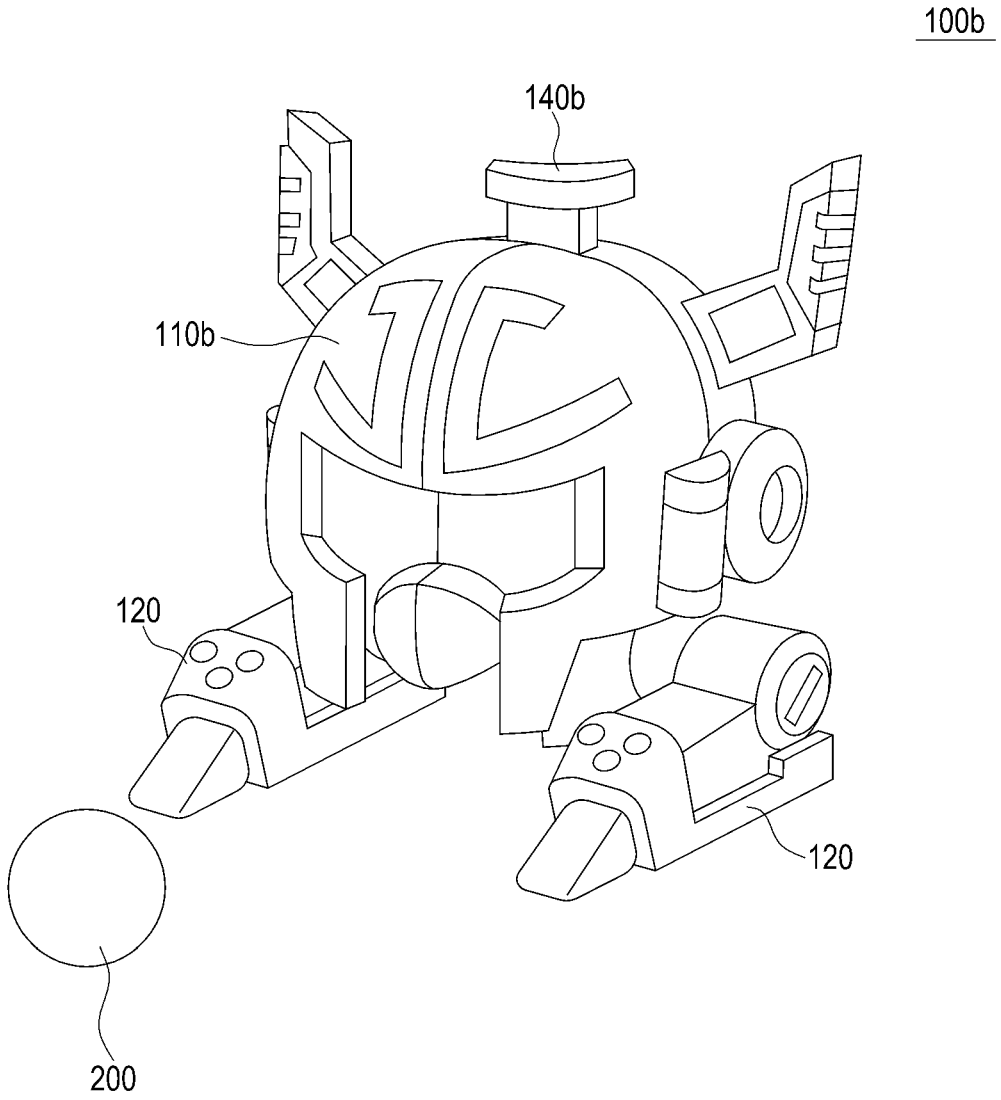
FIG. 13 is a perspective view showing a shooting type toy according to a third embodiment of the present invention.
Figure 14:
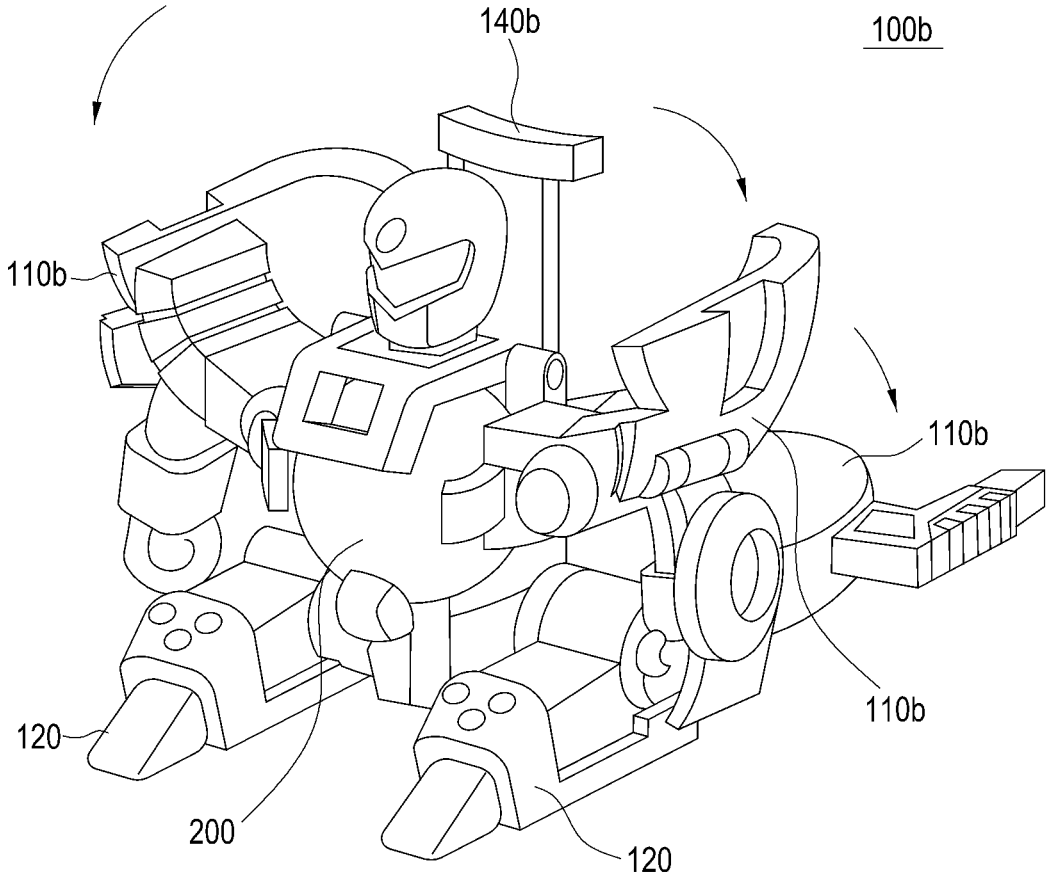
FIG. 14 is a perspective view showing an operation of the shooting type toy of FIG. 13.
Figure 15:
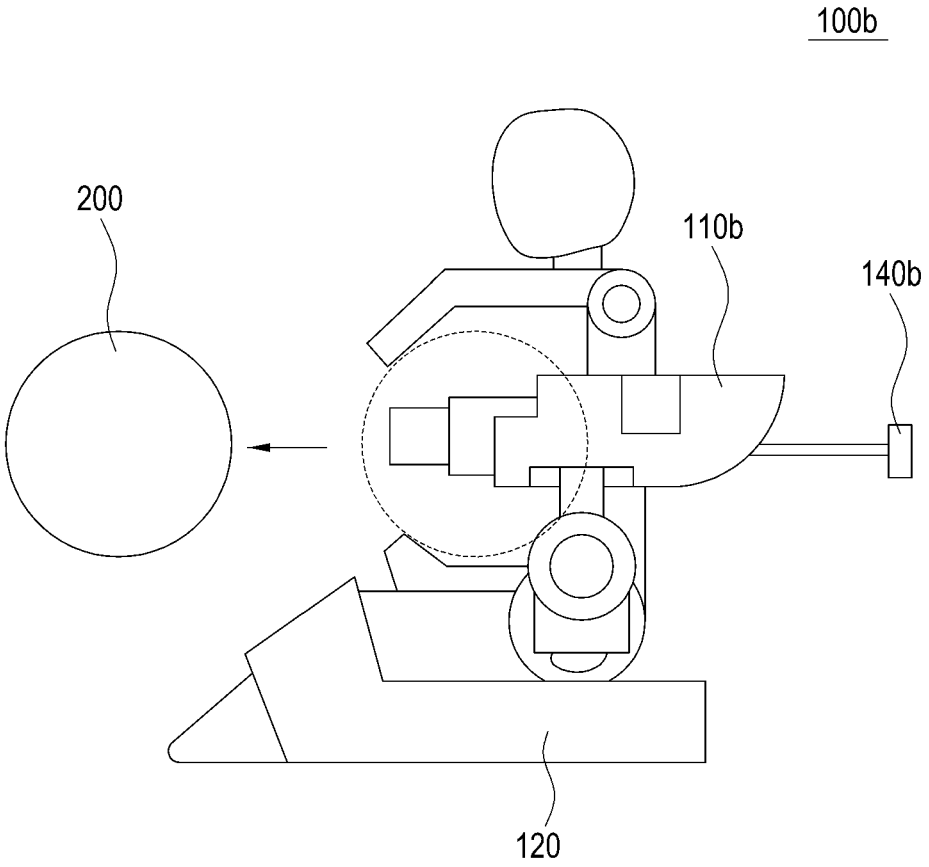
FIG. 15 is a side view showing the shooting type toy of FIG. 13.

FIG. 13 is a perspective view showing a shooting type toy according to a third embodiment of the present invention, FIG. 14 is a perspective view showing an operation of the shooting type toy of FIG. 13, and FIG. 15 is a side view showing the shooting type toy of FIG. 13.

As shown in FIGS. 13 to 15, a shooting type toy 100*b* according to a third embodiment of the present invention is configured to allow a body part 110*b* to which a plurality of members are rotatably coupled to transform in a process where an external form of the shooting type toy 100*b* transforms from a first form into a second form by means of contact and collision with a projectile 200. The parts for the transformation of the body part 110*b* are different from those in the shooting type toys 100 and 100*a* according to the first and second embodiments of the present invention.

According to the third embodiment of the present invention, in detail, the pop-up part 160 and the auxiliary pop-up parts 170 according to the first and second embodiments of the present invention are disposed on the body part 110*b* itself, so that if a latch part is released from a locking state thereof, the body part 110*b* itself is transformably developed in every direction.

Further, a pressurizing part 140*b* is rotatably disposed on one side of the body part 110*b* according to forms of the shooting type toy 100*b*.

Accordingly, if the projectile moving from the outside is inserted into the shooting type toy, the shooting type toy transforms from the first form into the second form. Next, the inserted projectile is fixed to the shooting type toy by means of the projectile fixing members and is then shot from the shooting type toy.

Fourth Embodiment

Figure 16:
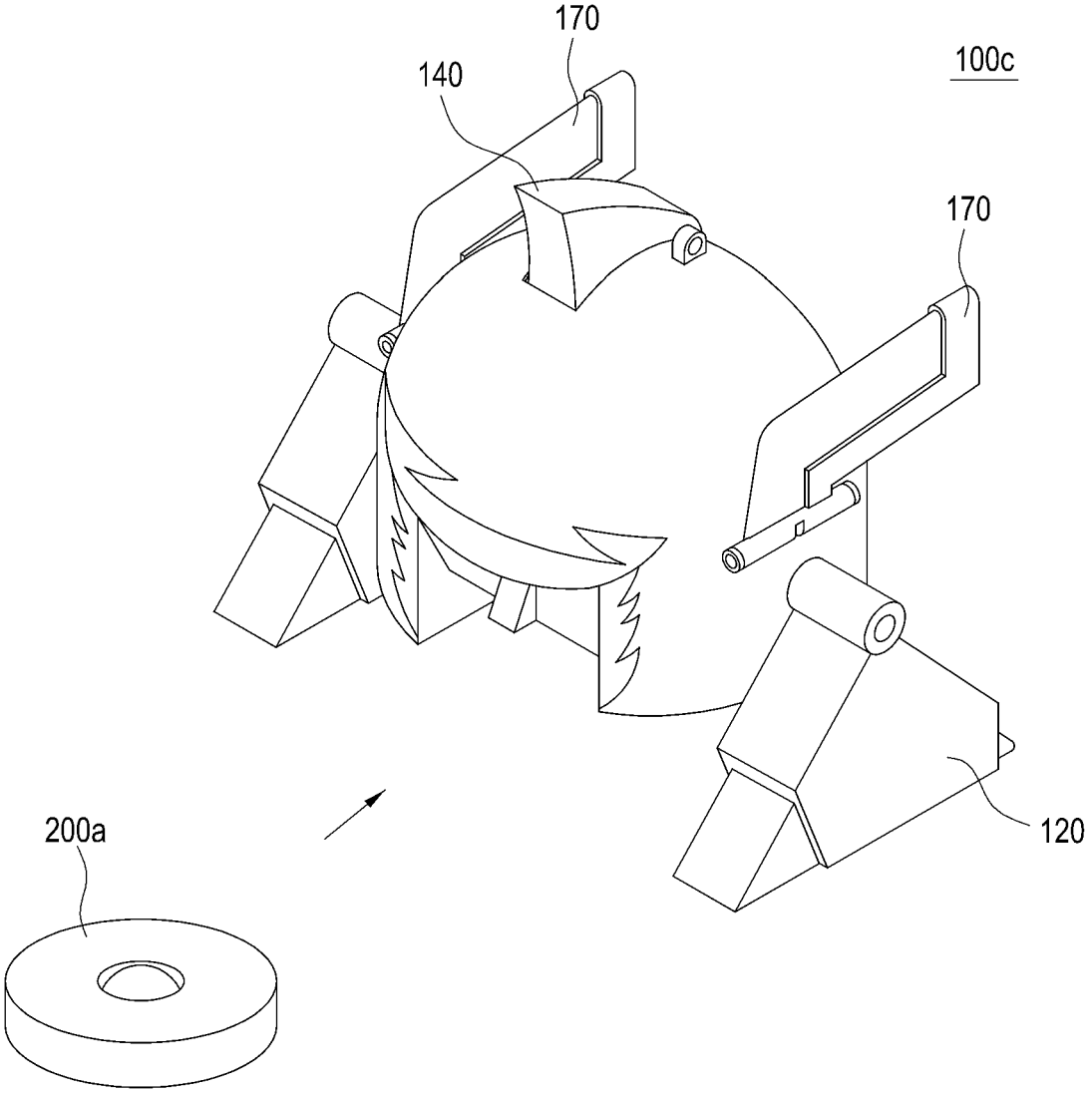
FIG. 16 is a perspective view showing a shooting type toy according to a fourth embodiment of the present invention.
Figure 17:
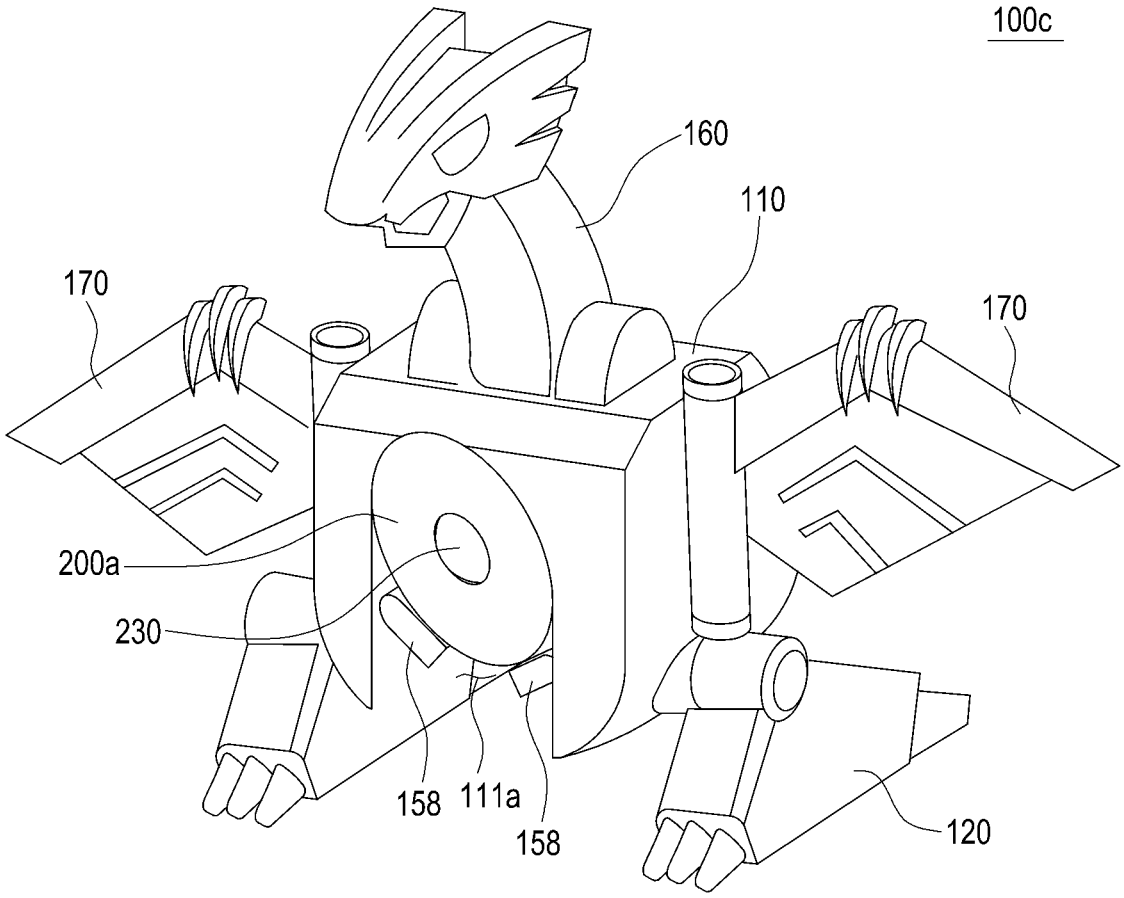
FIG. 17 is a perspective view showing an operation of the shooting type toy of FIG. 16.
Figure 18:
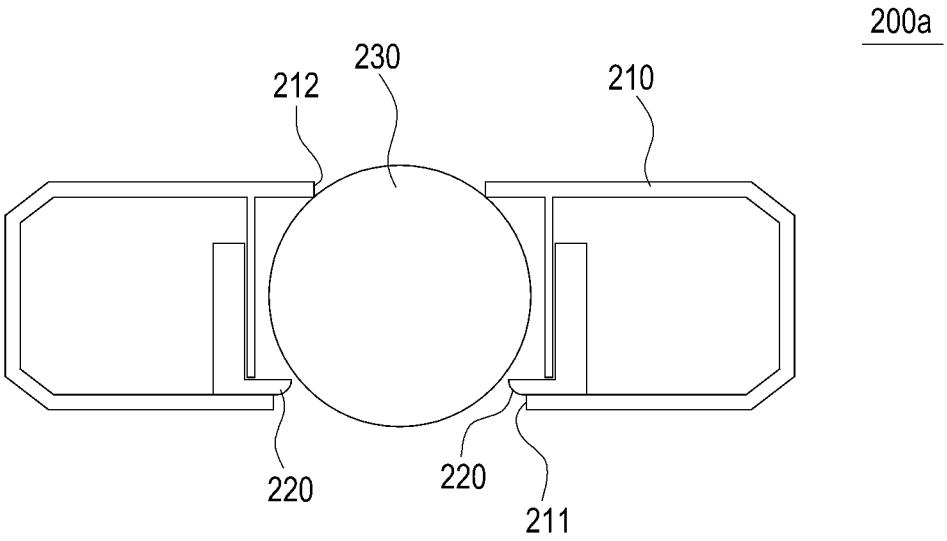
FIG. 18 is a sectional view showing a projectile of the shooting type toy of FIG. 16.

FIG. 16 is a perspective view showing a shooting type toy according to a fourth embodiment of the present invention, FIG. 17 is a perspective view showing an operation of the shooting type toy of FIG. 16, and FIG. 18 is a sectional view showing a projectile of the shooting type toy of FIG. 16.

As shown in FIGS. 16 to 18, a shooting type toy 100*c* according to a fourth embodiment of the present invention is configured to have a body part 110*c* and a projectile 200*a* different from those in the shooting type toys 100, 100*a*, and 100*b* according to the first to third embodiments of the present invention.

According to the fourth embodiment of the present invention, the body part 110*c* of the shooting type toy 100*c* has a relatively larger guide portion 111*a* than those in the shooting type toys 100, 100*a*, and 100*b* according to the first to third embodiments of the present invention so as to insert the disc-shaped projectile 200*a* thereinto, and projectile fixing members 158 are provided to fix the projectile 200*a* inserted into the guide portion 111*a* thereto.

The disc-shaped projectile 200*a* includes a projectile housing 210, projectile elastic members 220, and an auxiliary projectile 230.

The projectile housing 210 has a first projectile through hole 211 and a second projectile through hole 212 formed on the center thereof to seat the auxiliary projectile 230 thereonto.

The first projectile through hole 211 has a smaller diameter than the auxiliary projectile 230 inserted thereinto, and the second projectile through hole 212 has a larger diameter than the auxiliary projectile 230 inserted thereinto.

The projectile elastic members 220 are disposed in the second projectile through hole 212 of the projectile housing 210 to restrain the auxiliary projectile 230 seated onto the first projectile through hole 211 and the second projectile through hole 212 thereinto.

The auxiliary projectile 230 is seated onto the first projectile through hole 211 and the second projectile through hole 212, and if the pressurizing part pressurizes the auxiliary projectile 230 toward the second projectile through hole 212 from the first projectile through hole 211, the auxiliary projectile 230 is shot by means of the restraining forces of the projectile elastic members 220. Desirably, the auxiliary projectile 230 is formed of a spherical marble.

Accordingly, if the projectile 200*a* moving from the outside is inserted into the body part 110*c* of the shooting type toy 100*c*, the body part 110*c* is developed from the first form to the second form. Next, the inserted projectile 200*a* is fixed to the body part 110*c* by means of the projectile fixing members 158, and the auxiliary projectile 230 is then shot from the body part 110*c*.

Fifth Embodiment

Figure 19:
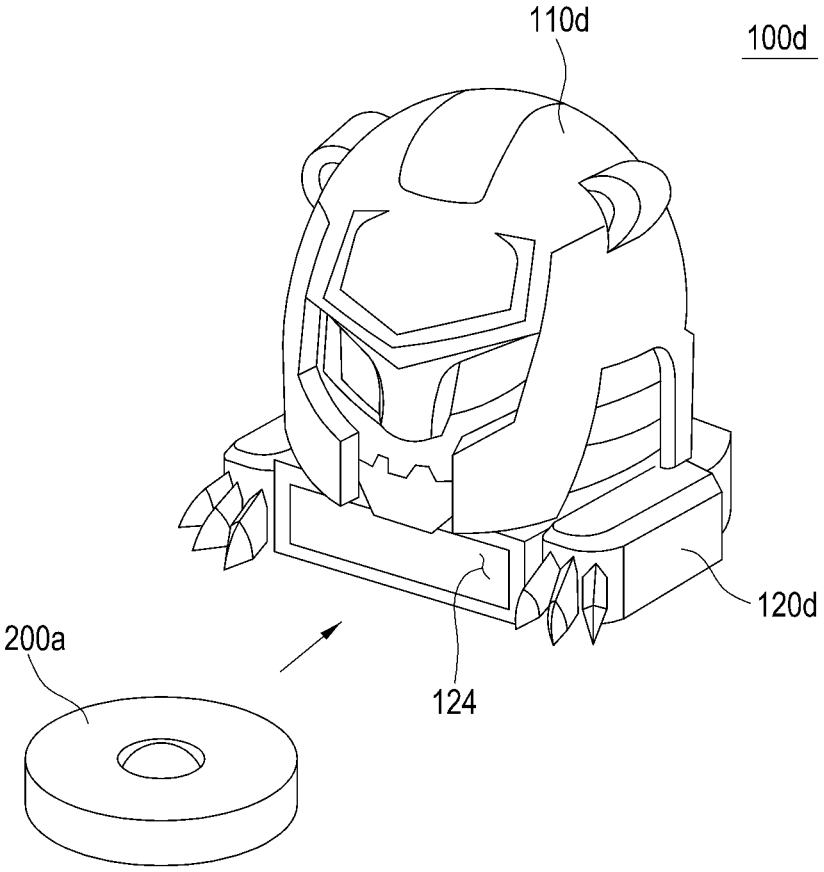
FIG. 19 is a perspective view showing a shooting type toy according to a fifth embodiment of the present invention.
Figure 20:
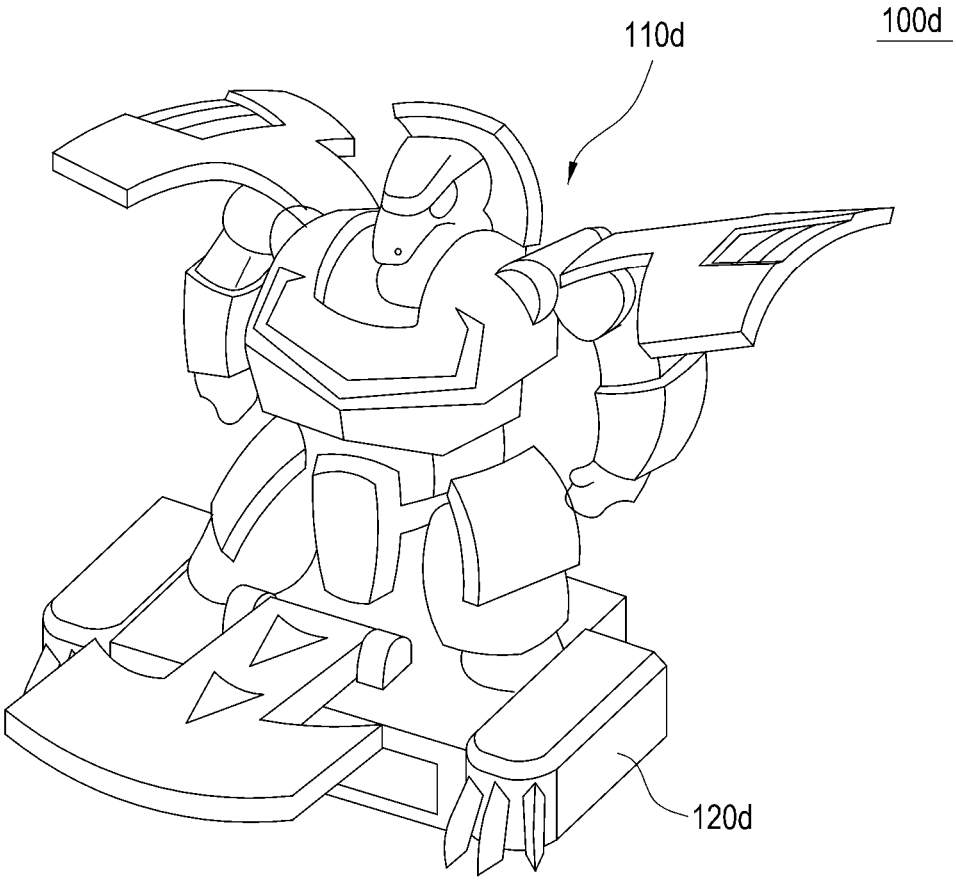
FIG. 20 is a perspective view showing an operation of the shooting type toy of FIG. 19.
Figure 21:
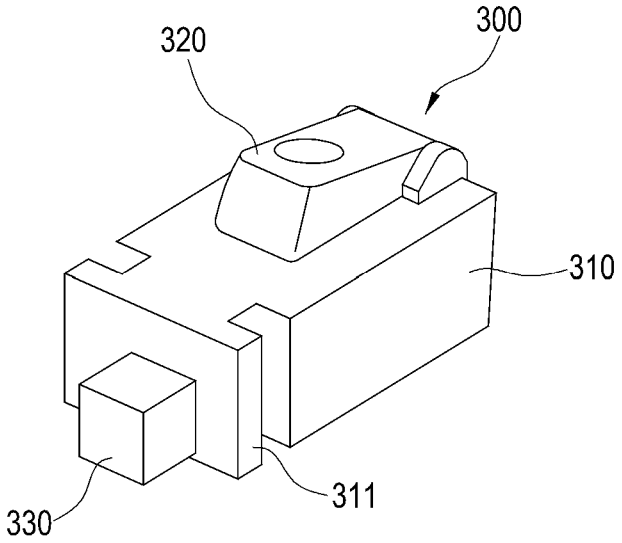
FIG. 21 is a perspective view showing a projectile shooting part of the shooting type toy of FIG. 19.
Figure 22:
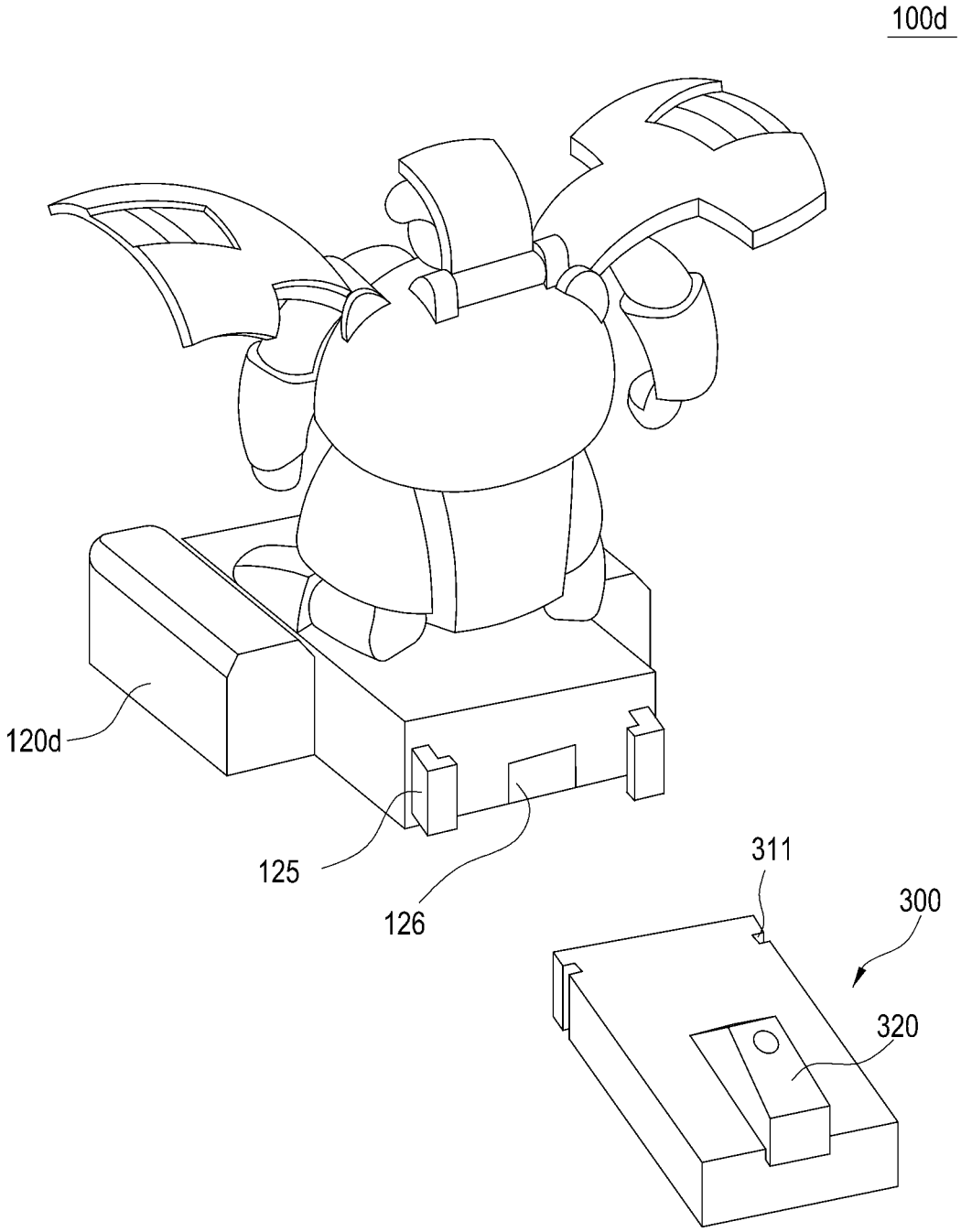
FIG. 22 is a perspective view showing a shooting operation of the shooting type toy of FIG. 19.

FIG. 19 is a perspective view showing a shooting type toy according to a fifth embodiment of the present invention, FIG. 20 is a perspective view showing an operation of the shooting type toy of FIG. 19, FIG. 21 is a perspective view showing a projectile shooting part of the shooting type toy of FIG. 19, and FIG. 22 is a perspective view showing a shooting operation of the shooting type toy of FIG. 19.

As shown in FIGS. 19 to 22, a shooting type toy 100*d* according to a fifth embodiment of the present invention is configured to have a body part 110*d* pop up forwardly, backwardly, upwardly or laterally therefrom, a support part 120*d* having a latch adapted to allow the body part 110*d* to pop up if a projectile 200*a* is inserted thereinto, and an auxiliary pressurizing part 300 for shooting the projectile 200*a* inserted into the support part 120*d*.

According to the fifth embodiment of the present invention, in detail, the shooting type toy 100*d* has the body part 110*d* released from a locking state thereof to pop up if the disc-shaped projectile 200*a* is inserted into the support 120*d* open on one side thereof, so that the projectile 200*a* inserted into the support part 120*d* is shot by means of the auxiliary pressurizing part 300 coupled to the other side of the support part 120*d*.

The pop-up part and the auxiliary pop-up parts of the first and second embodiments of the present invention are disposed on the body part 110*d* itself, and if the locking state of the latch is released, the body part 110*d* itself is developed in every direction and upwardly and thus transforms.

The support part 120*d* has a projectile insertion portion 124 formed on one side open thereof to insert the projectile 200*a* thereinto and the latch disposed in an interior thereof in such a manner as to be released from the locking state through the contact or collision with the projectile 200*a* to allow the body part 110*d* to transform from a first form into a second form.

Further, the support part 120*d* has auxiliary pressurizing part fastening grooves 125 and a support through hole 126 formed on the other side thereof in such a manner as to be coupled to the auxiliary pressurizing part 300 to allow the projectile 200*a* to be shot therefrom.

The auxiliary pressurizing part 300 is coupled to one side of the support part 120*d* to allow the projectile 200*a* inserted into the support part 120*d* to be pressurizedly shot from the outside and includes an auxiliary pressurizing part body 310, an auxiliary pressurizing part lever 320 disposed on the auxiliary pressurizing part body 310 to detect a pressurizing force from a user, and an auxiliary pressurizing part firing pin 330 operating according to an operation of the auxiliary pressurizing part lever 320 to pressurize or hit the projectile 200*a* thereagainst.

In detail, the auxiliary pressurizing part 300 further has auxiliary pressurizing part coupling grooves 311 interlocked with the auxiliary pressurizing part fastening grooves 125 formed on one side of the support part 120*d*, so that it can be fixed to the support part 120*d*, and if the auxiliary pressurizing part lever 320 is pressed by the user, the auxiliary pressurizing part firing pin 330 passes through the support part through hole 126 and pressurizes or hits the projectile 200*a* thereagainst to allow the projectile 200*a* to be shot.

According to the fifth embodiment of the present invention, the projectile is disc-shaped, but it is not limited thereto. That is, the projectile may have various forms such as a spherical, polygonal, polyhedral, and ring form.

Accordingly, if the projectile 200*a* moving from the outside is inserted into the support part 120*d* of the shooting type toy 100*d*, the body part 110*d* developedly pops up from the first form to the second form. Next, the inserted projectile 200*a* is shot by means of the auxiliary pressurizing part 300 coupled to one side of the support part 120*d*.

Sixth Embodiment

Figure 23:
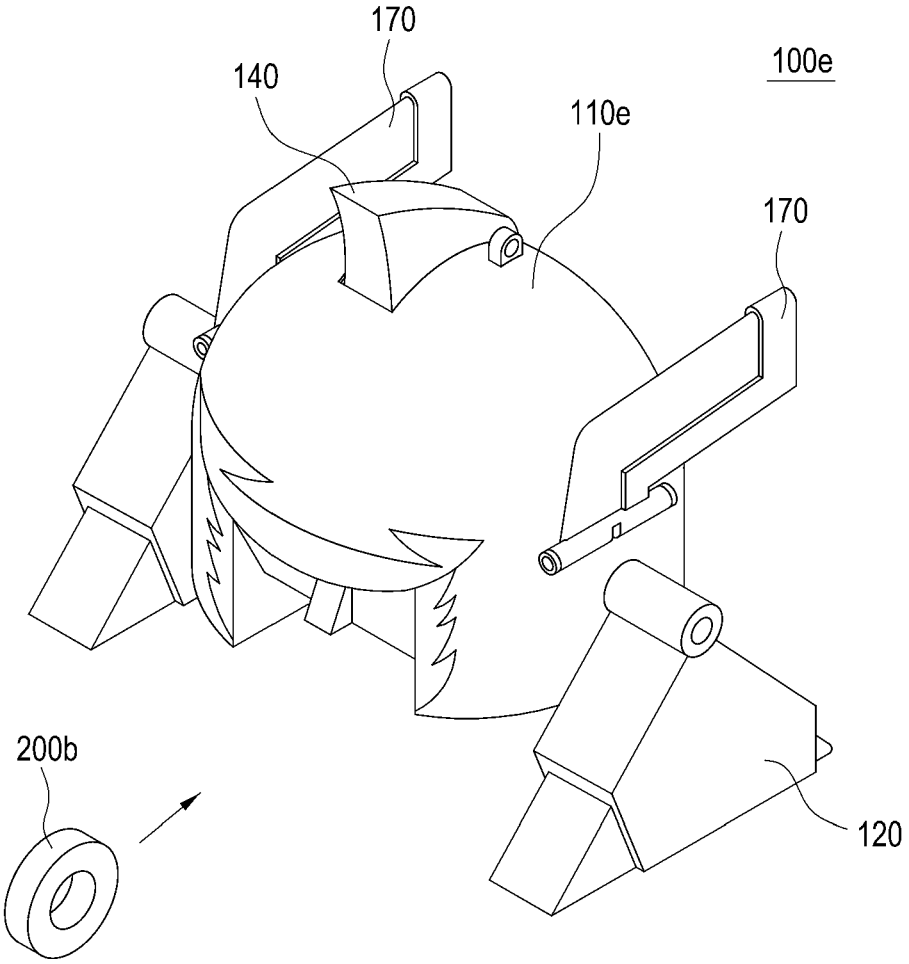
FIG. 23 is a perspective view showing a shooting type toy according to a sixth embodiment of the present invention.
Figure 24:
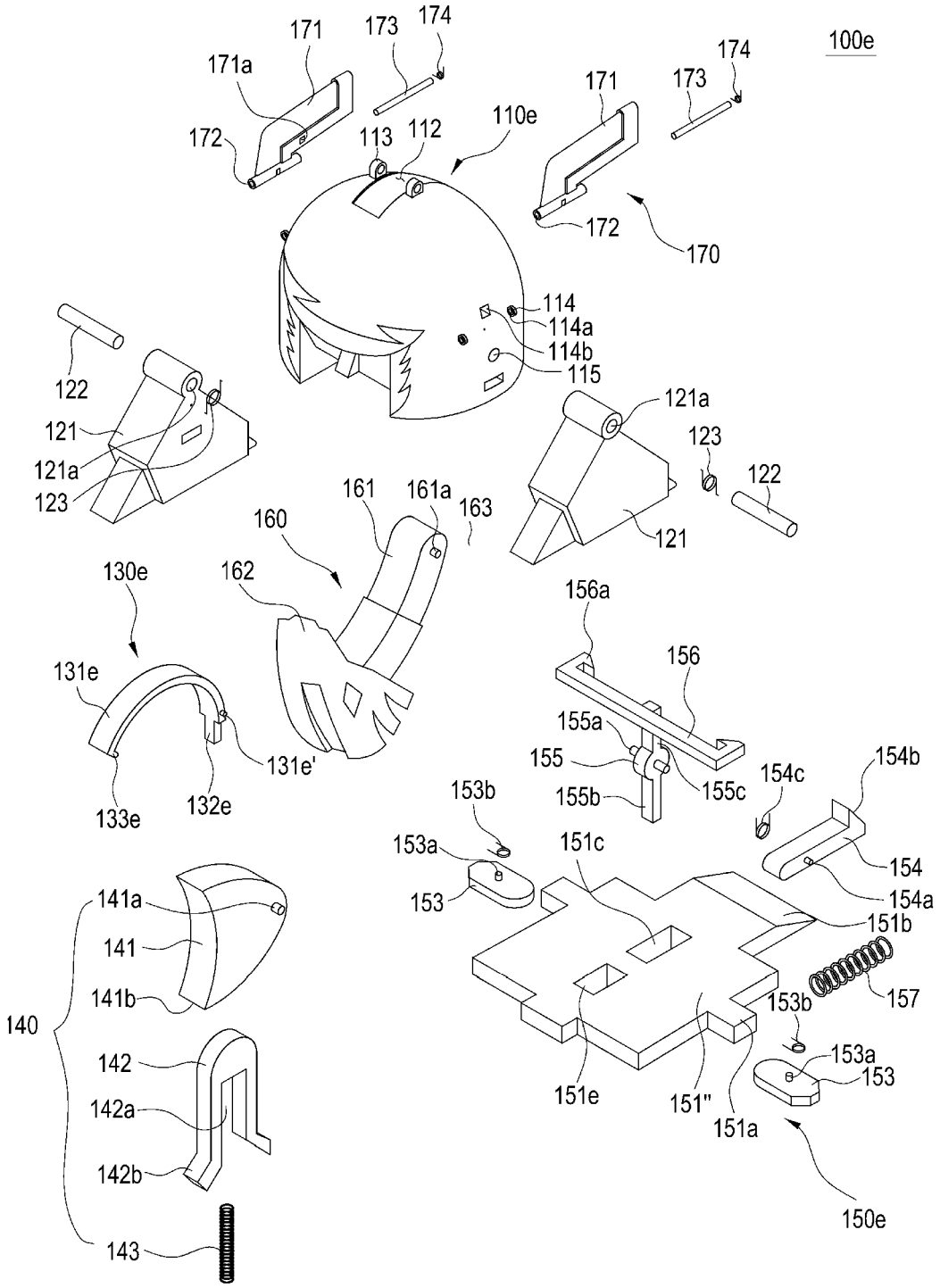
FIG. 24 is an exploded perspective view showing the shooting type toy of FIG. 23.
Figure 25:
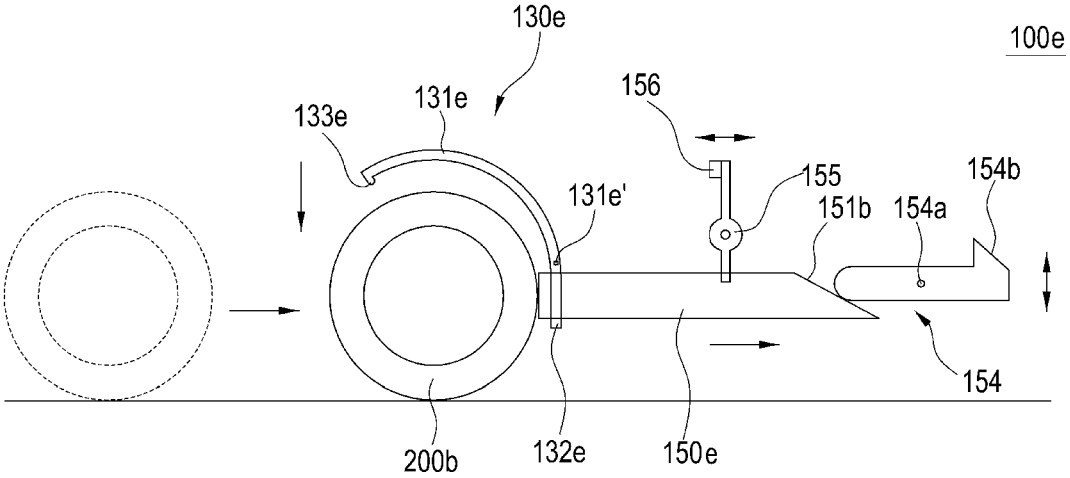
FIG. 25 is a side view showing an operation of the shooting type toy of FIG. 23.
Figure 26:
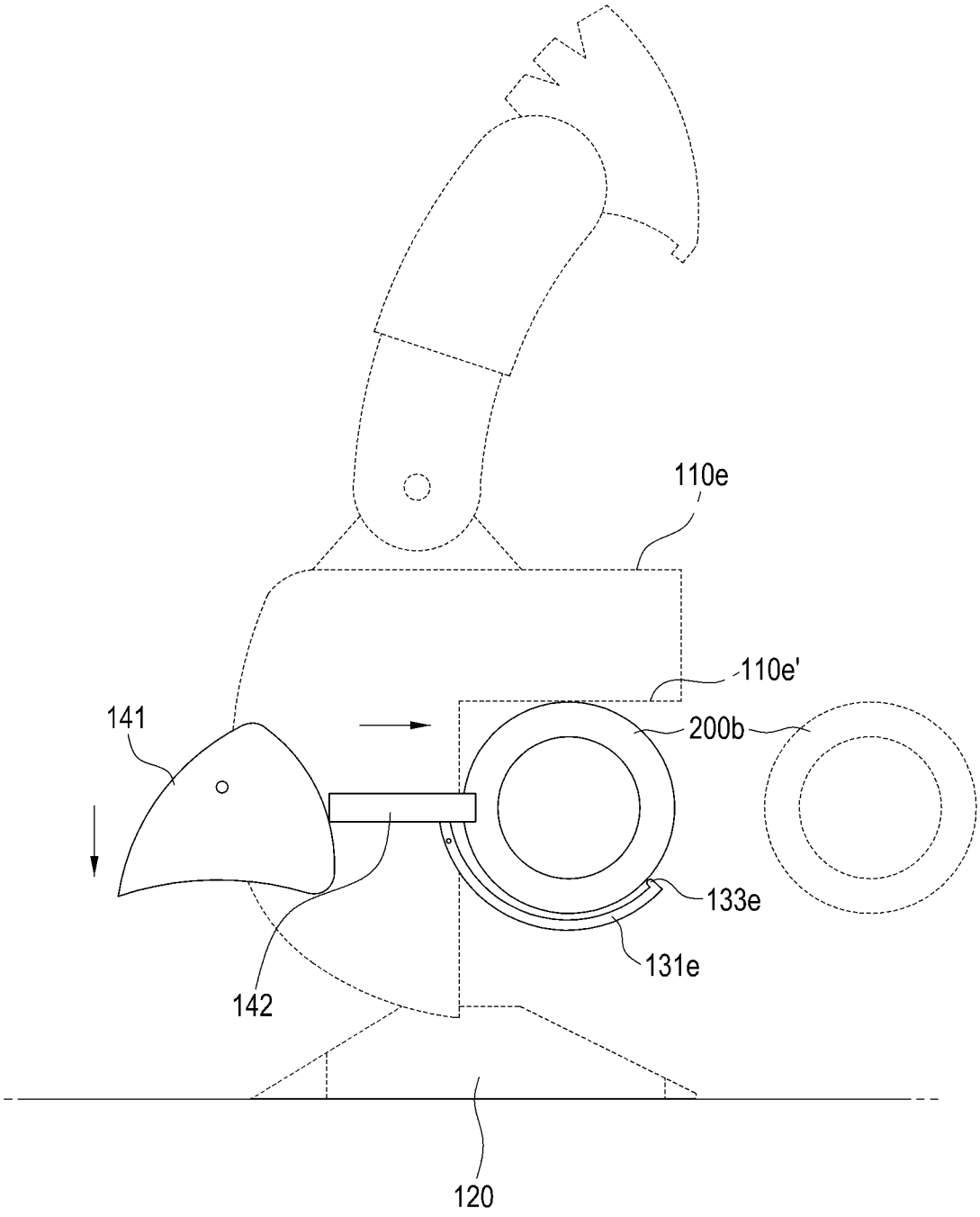
FIG. 26 is a side view showing another operation of the shooting type toy of FIG. 23.
Figure 27:
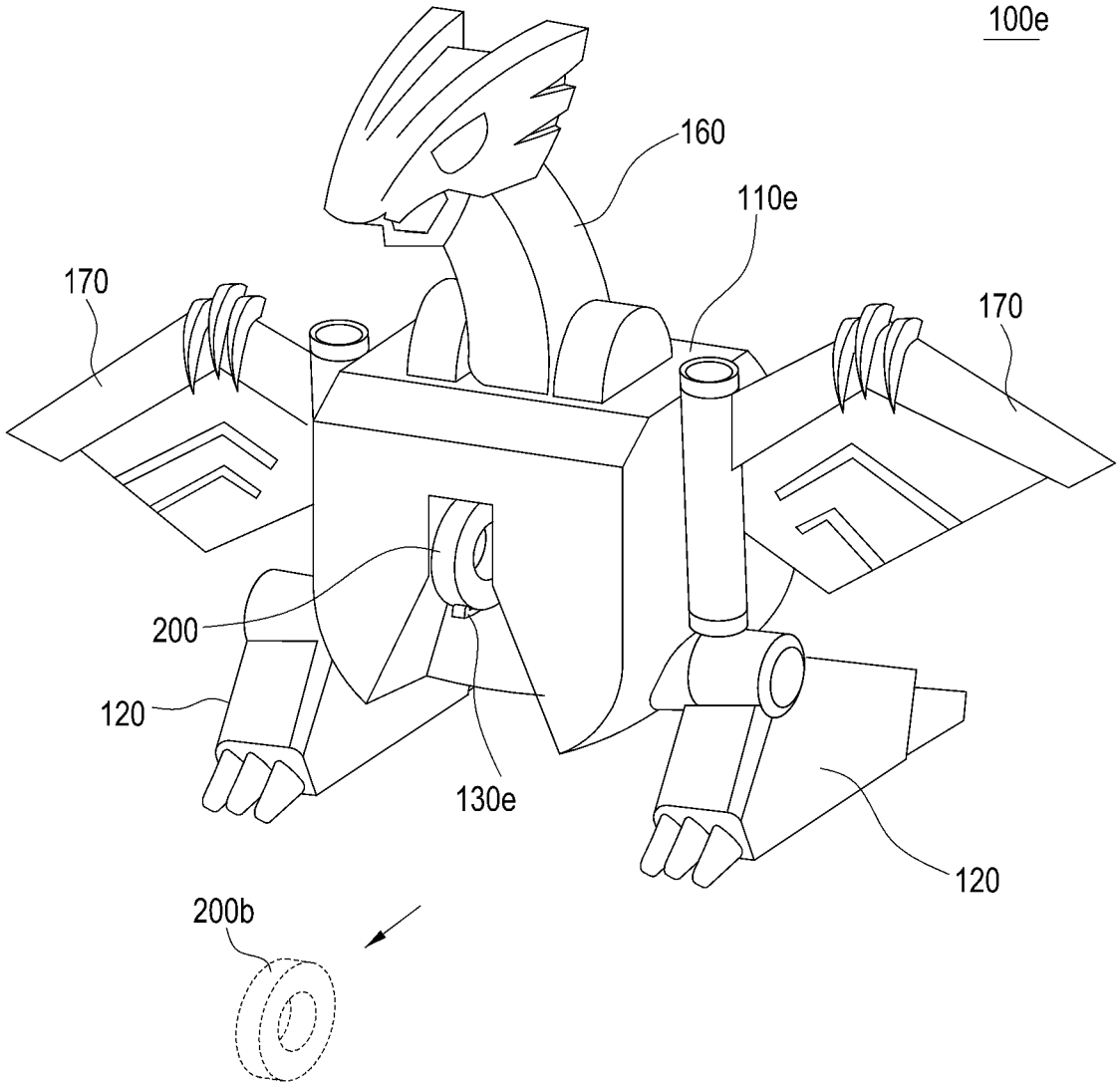
FIG. 27 is a side view showing a shooting operation of the shooting type toy of FIG. 23.

FIG. 23 is a perspective view showing a shooting type toy according to a sixth embodiment of the present invention, FIG. 24 is an exploded perspective view showing the shooting type toy of FIG. 23, FIG. 25 is a side view showing an operation of the shooting type toy of FIG. 23, FIG. 26 is a side view showing another operation of the shooting type toy of FIG. 23, and FIG. 27 is a side view showing a shooting operation of the shooting type toy of FIG. 23.

First, the repeated explanation on the same parts as in the second embodiment of the present invention will be avoided, and the same reference numerals will be used to describe the same components.

As shown in FIGS. 23 to 27, a shooting type toy 100*e* according to a sixth embodiment of the present invention includes a body part 110*e*, support parts 120, a shooting part 130*e*, a pressurizing part 140, a latch part 150*e*, a pop-up part 160, auxiliary pop-up parts 170, and a projectile 200*b*, wherein the body part 110*e* is lockedly set by the latch part 150*e* in such a manner as to be kept to a first form in an external form thereof, and if the projectile 200*b* moving from the outside is inserted into the body part 110*e* to release a locking state of the latch part 150*e*, the body part 110*e* is developed to allow the external form thereof to transform into a second form from the first form. After that, the inserted projectile 200*b* is restrained into the shooting part 130*e* disposed in the body part 110*e*, and if the projectile 200*b* is pressurized against the pressurizing part 140, the projectile 200*b* is shot from the body part 110*e* by means of a restraining force applied to the shooting part 130*e*.

According to the sixth embodiment of the present invention, the shooting type toy 100*e* has the shooting part 130*e*, the latch part 150*e* and the projectile 200*b* configured differently from those according to the second embodiment of the present invention.

The shooting part 130*e* is disposed in the body part 110*e* and is formed of an arch or semicircular-shaped elastic body open on one side thereof in such a manner as to fix the projectile 200*b* to the inside of the body part 110*e* to allow the fixed projectile 200*b* to be shot toward the open body part 110*e* by means of the elastic force of the shooting part 130*e*. The shooting part 130*e* includes a shooting part body 131*e*, a shooting part link 132*e*, and a shooting part protrusion 133*c*.

The shooting part body 131*e* is an arch-shaped member having a given elastic force and has the shooting part link 132*e* formed on one side thereof and the shooting part protrusion 133*c* protruding from the other side thereof. Further, the shooting part body 131*e* has a shooting part rotary shaft 131*e*' disposed on the shooting part link 132*e* side thereof so that it rotates around the shooting part rotary shaft 131*e*'.

Further, the shooting part body 131*e* comes into contact with the projectile 200*b* to allow the projectile 200*b* to pressurizedly contacted with a body part inner surface 110*e*', so that the projectile 200*b* is fixed to the body part inner surface 110*e*'.

The shooting part link 132*e* is interlocked with a fifth contact portion 151*e* of the latch part 150*e* to allow the end of the shooting part 130*e* to rotate around the shooting part rotary shaft 131*e*' according to horizontal displacement of the latch part 150*e*.

The shooting part protrusion 133*c* comes into contact with the projectile 200*b* contacted with the inner surface of the shooting part body 131*e* to allow the projectile 200*b* to be more rigidly fixed thereto and serves to increase an amount of displacement of the shooting part body 131*e* in a process where the projectile 200*b* is shot, thereby allowing shooting elasticity for the projectile 200*b* to be more raised.

The latch part 150*e* is disposed in the body part 110*e* and is displaced to a locking position or a locking releasing position by means of the projectile 200*b*. The latch part 150*e* includes a latch part body 151", a latch actuator 152*a*, first locking members 153, a second locking member 154, a link 155, a third locking member 156, and a latch part spring 157.

The latch part body 151" is disposed under the body part 110*e* and if it collides against the projectile 200*b*, it moves horizontally to allow the first to third locking members 153, 154 and 156 to be released from locking states thereof. The latch part body 151" serves to come into close contact with the projectile 200*b* and includes first contact portions 151*a*, a second contact portion 151*b*, a third contact portion 151*c* and the fifth contact portion 151*e*.

The fifth contact portion 151*e* is formed on the latch part body 151" to allow the shooting part 130*e* to rotate, and in detail, the fifth contact portion 151*e* is a rectangular through hole formed in a longitudinal direction of the latch part body 151" or a rectangular through hole into which the shooting part link 132*e* is inserted.

That is, the fifth contact portion 151*e* is adapted to insert the shooting part link 132*e* thereinto, and if the latch part body 151" moves horizontally, the shooting part link 132*e* moves to allow the shooting part 130*e* to rotate around the shooting part rotary shaft 131*e'*.

The projectile 200*b* is a ring-shaped member and rolls by a user or is shot from a given shooting device (not shown) toward the shooting type toy 100*e*. The projectile 200*b* is made of a metal or plastic resin material.

According to the sixth embodiment of the present invention, on the other hand, the projectile 200*b* is ring-shaped, but it is not limited thereto. Of course, it is obvious to those skilled in the art that the projectile is a rollable object such as disc, cylinder, or the like.

Next, an explanation on an operation of the shooting type toy 100*e* according to the sixth embodiment of the present invention will be given.

The pop-up part 160 and the auxiliary pop-up parts 170 are fixedly brought into contact with the body part 110*e*, and the body part 110*e* fixedly rotates around the rotary shafts 122 of the support parts 120, so that the external form of the shooting type toy 100*e* is kept to the first form.

The shooting type toy 100*e* kept to the first form is located at an arbitrary position, and the projectile 200*b* is shot to move to the shooting type toy 100*e* by means of the user.

The projectile 200*b* is inserted into one side open of the body part 110*e* and moves along the guide portion, and the latch actuator 152*a* of the latch part 150*e* disposed in the body part 110*e* is displaced to the moving direction of the projectile 200*b* by means of the physical contact or collision with the projectile 200*b*.

If the latch part 150*e* moves, the first to third contact portions 151*a*, 151*b* and 151*c* of the latch part 150*e* also move, so that the first locking members 153, the second locking member 154, and the third locking member 156 operating cooperatively with the link 155 are displaced from locking positions to locking releasing positions, and the shooting part 130*e* rotates to come into close contact with the outer periphery of the projectile 200*b*, so that the projectile 200*b* is fixed to the shooting part 130*e*.

If the positions of the first to third locking members 153, 154 and 156 are displaced, the body part 110*e*, the pop-up part 160 and the auxiliary pop-up parts 170, which are fixedly interlocked with the first to third locking members 153, 154 and 156, rotate around the support parts 120 or are developed around the body part 110*e*, so that the external form of the shooting type toy 100*e* transforms from the first form into the second form.

On the other hand, if the shooting type toy 100*e* transforms into the second form by means of the projectile 200*b*, the inserted projectile 200*b* is restrained in the state of being seated onto the body part housing and the shooting part 130*e* by means of the shooting part 130*e*.

After that, if the lever 141 of the pressurizing part 140 is pressed by the user, it rotates around the first hinges 113, and the cam 141*b* formed on one side of the lever 141 pressurizes the firing pin 142 thereagainst to allow the firing pin 142 to move horizontally so that the projectile 200*b* is shot by means of the elastic force of the shooting part 130*e*.

Figure 28:
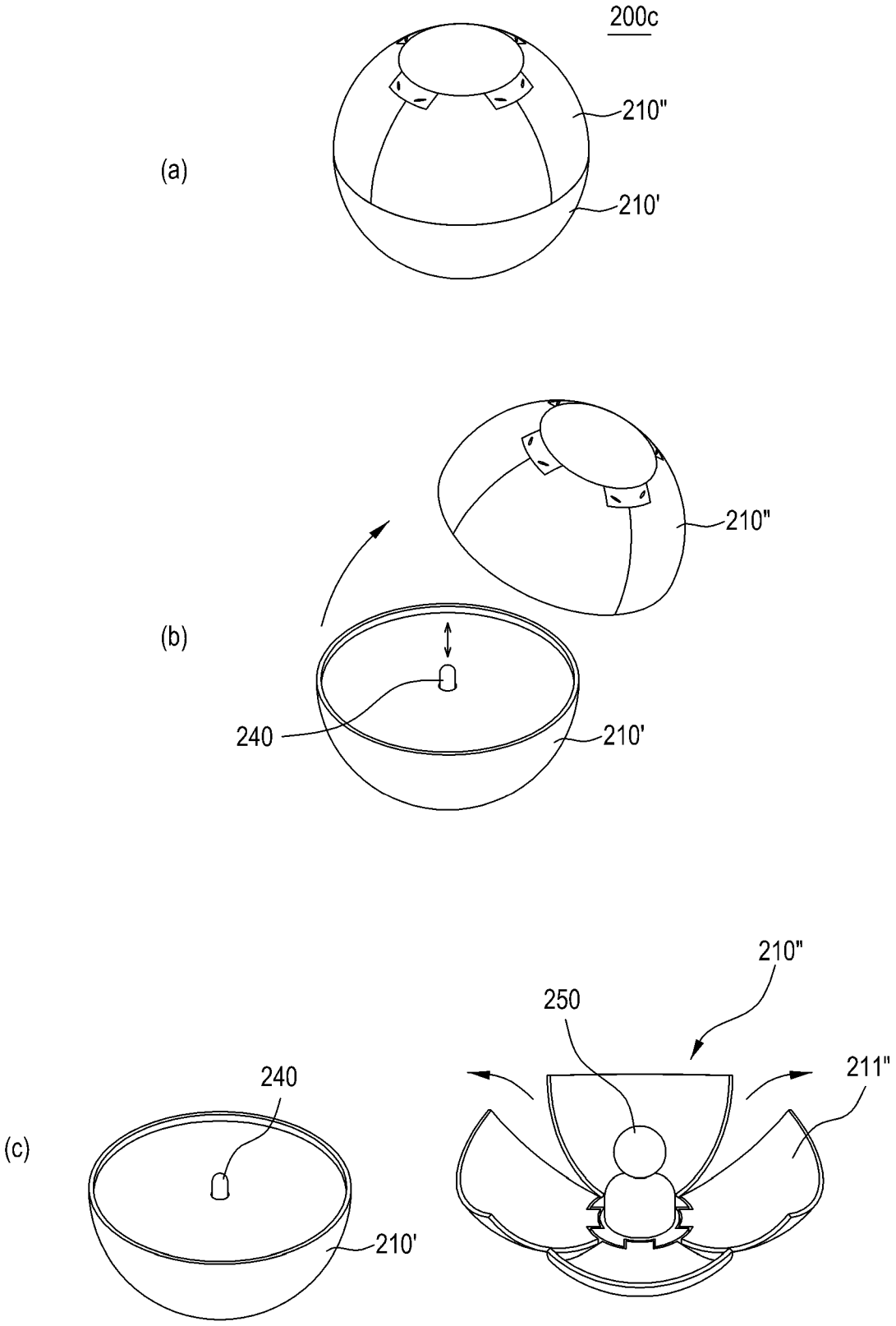
FIG. 28 is a perspective view showing another example of a projectile of the shooting type toy according to the present invention.

Further, FIG. 28 is a perspective view showing another projectile 200*c* of the shooting type toy according to the present invention, and the projectile 200*c* includes a first projectile housing 210' and a second projectile housing 210", so that if it is shot to collide against the ground, it is developed to allow an external form thereof to transform from a first form into a second form.

In detail, the projectile 200*c* includes the first projectile housing 210' and the second projectile housing 210" coupled separably to each other.

The first projectile housing 210' and the second projectile housing 210" are hemispherical members fittedly coupled to each other to keep a spherical form, and if they are shot by means of the shooting part, they are separated from each other by means of a force generated by the collision with the ground, thereby allowing the projectile 200*c* to transform into the second form.

Further, the first projectile housing 210' has a projectile firing pin 240 disposed therein in such a manner as to be displaced upon occurrence of collision to hit or pressurize the second projectile housing 210" thereagainst, so that the first projectile housing 210' and the second projectile housing 210" can be more easily separated from each other.

Further, the second projectile housing 210" has a plurality of flaps 211" rotatably disposed around a projectile base 250, and if the projectile base 250 hits against the projectile firing pin 240, the second projectile housing 210" is separated from the first projectile housing 210' to allow the flaps 211" to be developed, so that the external form of the projectile 200*c* transforms into the second form from the first form.

According to the present invention, the projectile 200*c* is formed of the two housings completely separated from each other, but it is not limited thereto. Of course, the projectile 200*c* may be provided to allow a portion thereof to be rotatingly or separately developed from the other portion coupled thereto, without being completely separated therefrom.

Accordingly, if the projectile made of the non-magnetic material moving from the outside is inserted into the shooting type toy, the shooting type toy is developed from the first form to the second form, and the inserted projectile is fixed to the shooting type toy by means of the projectile fixing members and is then shot from the shooting type toy.

While the present invention has been described with reference to the particular illustrative embodiments, it is not to be restricted by the embodiments but only by the appended claims. It is to be appreciated that those skilled in the art can change or modify the embodiments without departing from the scope and spirit of the present invention.

In the description, the thicknesses of the lines or the sizes of the components shown in the drawing may be magnified for the clarity and convenience of the description. Further, the terms as will be discussed later are defined in accordance with the functions of the present invention, but may be varied under the intention or regulation of a user or operator. Therefore, they should be defined on the basis of the whole scope of the present invention.

EXPLANATIONS ON REFERENCE NUMERALS

100, 100*a*, 100*b*, 100*c*, 100*d*, 100*e*: shooting type toy
110, 110*a*, 110*b*, 110*c*, 110*d*, 110*e*: body part
111: body part housing 112: lever through hole
113: first hinge 114: second hinge
114*b*: third locking member through hole
115: support part coupling hole
115*a*: first locking member through hole
116; third hinge
120, 120*d*: support part 121: support part body
121*b*: first locking member fixing groove
122: rotary shaft
123: support part spring
124: projectile insertion hole
125: auxiliary pressurizing part fastening groove
126: support part through hole
130, 130*e*: shooting part 131,131*e*: shooting part body
131*a*, 133*e*: shooting part protrusion
132*e*: shooting part link
140, 140*b*: pressurizing part 141: lever
141*b*: cam 142: firing pin
142*a*: firing pin insertion groove
143: firing pin spring
150, 150*a*: latch part
151, 151', 151": latch part body
151*a*: first contact portion
151*b*: second contact portion
151*c*: third contact portion
151*d*: fourth contact portion
151*e*: fifth contact portion 152: latch actuator
153: first locking member
154: second locking member
155: link 156: third locking member
157: latch part spring
158: projectile fixing member
159: fixing member spring 160: pop-up part
161: first pop-up part body
162: second pop-up part body
162*a*: second locking member fixing groove
170: auxiliary pop-up part
171: auxiliary pop-up part body
171*a*: third locking member fixing groove
172: auxiliary pop-up part hinge
173: rotary shaft
174: auxiliary pop-up part spring
200, 200*a*, 200*b*, 200*c*: projectile
210: projectile housing
210': first projectile housing
210": second projectile housing
211: first projectile through hole
211": flap 212: second projectile through hole
220: projectile elastic member
230: auxiliary projectile
240: projectile firing pin
250: projectile base
300: auxiliary pressurizing part
310: auxiliary pressurizing part body
311: auxiliary pressurizing part coupling groove
320: auxiliary pressurizing part lever
330: auxiliary pressurizing part firing pin

The invention claimed is:

1. A shooting toy comprising:

a body having a plurality of members;

a latch part (150, 150*a*, 150*e*) for locking the body thereonto to allow the body to be kept to a first form; and a projectile (200, 200*a*, 200*b*, 200*c*) moving from the outside in such a manner as to be inserted into the body and thus located in a shooting part (130, 130*e*) disposed in the body, wherein the projectile (200, 200*a*, 200*b*, 200*c*) releases a locking state of the latch part (150, 150*a*, 150*e*) to allow the body to be developed to a second form, and wherein in response to the projectile located in the shooting part, the projectile is shot from the body developed to the second form by means of a pressurizing part disposed in the body.

2. The shooting toy according to claim 1, further comprising pop-up parts (160 and 170) rotatably coupled to the body in such a manner as to be released from the body if the latch part (150, 150*a*, 150*e*) is released from the locking state thereof.

3. The shooting toy according to claim 2, further comprising support parts (120, 120*d*) disposed on the body in such a manner as to, if the latch part (150, 150*a*, 150*e*) is released from the locking state thereof, support the body thereagainst to allow the body to rotate forwardly or backwardly or to pop up forwardly, backwardly, upwardly or laterally.

4. The shooting toy according to claim 3, wherein each support part (120) comprises a plurality of wheels.

5. The shooting toy according to claim 3, wherein the body comprises:

a body part (110, 110*a*, 110*b*, 110*c*, 110*d*, 110*e*) having an accommodation space formed at the inside thereof;

the shooting part (130, 130*e*) is disposed in the body part (110, 110*a*, 110*b*, 110*c*, 110*d*, 110*e*) in such a manner as to allow the inserted projectile (200, 200*a*, 200*b*, 200*c*) to be seated and restrained thereinto;

the pressurizing part (140, 140*b*) moves the projectile (200, 200*a*, 200*b*, 200*c*) to a front end of the shooting part (130, 130*e*) and pressurizes the projectile (200, 200*a*, 200*b*, 200*c*) thereagainst so that the projectile (200, 200*a*, 200*b*, 200*c*) is shot by means of an elastic force of the shooting part (130, 130*e*); and the latch part (150, 150*a*, 150*e*) is disposed in the body part (110, 110*a*, 110*b*, 110*c*, 110*d*, 110*e*) in such a manner as to be displaced to a locking position or a locking releasing position by means of the projectile (200, 200*a*, 200*b*, 200*c*).

6. The shooting toy according to claim 5, wherein the body part (110) comprises:

a body part housing (111) formed of at least one or more members and having a guide portion (111*a*) adapted to guide a moving path of the projectile (200, 200*a*, 200*c*) if the projectile (200, 200*a*, 200*c*) is inserted thereinto;

a lever through hole (112) pierced into the body part housing (111); and a plurality of hinges (113, 114, and 116) adapted to support the pop-up parts, the support parts (120), and the pressurizing part (140) thereagainst in such a manner as to allow the pop-up parts, the support parts (120), and the pressurizing part (140) to be rotatably coupled to the body part housing (111).

7. The shooting toy according to claim 6, wherein the body part (110) has the first form having at least one selected from a mask, a combat helmet, a shield, a car, a building, an egg, an animal, and other forms, and the second form is at least one selected from an animal, a robot, a dinosaur, and animation character forms.

8. The shooting according to claim 5, wherein the shooting part (130) is formed of an arch-shaped elastic body open on one side thereof.

9. The shooting according to claim 5, wherein the pressurizing part (140) comprises:

a lever (141) rotatably coupled to the lever through hole (112);

a firing pin (142) connected to the lever (141) on one side thereof and when the lever (141) is operated, presses the projectile (200, 200*a*, 200*b*, 200*c*); and a firing pin spring (143) for providing an elastic force for the firing pin (142) so that the firing pin (142) is kept to a given position.

10. The shooting toy according to claim 5, wherein the latch part (150) is displaced through an attractive force generated from a magnetic field with the projectile (200, 200*a*, 200*b*, 200*c*).

11. The shooting toy according to claim 5, wherein the latch part (150*a*, 150*e*) is displaced through physical contact with the projectile (200, 200*a*, 200*b*, 200*c*).

12. The shooting toy according to claim 5, wherein the latch part (150, 150*a*, 150*e*) comprises a plurality of locking members (153, 154 and 156) adapted to allow the body part (110, 110*a*, 110*b*, 110*c*, 110*d*, 110*e*) and the pop-up parts (160 and 170) to be restrainedly kept to the first form, and if the latch part (150, 150*a*, 150*e*) is displaced, adapted to allow the body part (110, 110*a*, 110*b*, 110*c*, 110*d*, 110*e*) and the pop-up parts (160 and 170) to be released.

13. The shooting toy according to claim 12, wherein the latch part (150*a*) further comprises projectile fixing members (158) for restrainedly fixing the inserted projectile (200, 200*a*, 200*b*, 200*c*) thereto and fixing member springs (159) for providing elastic forces for the projectile fixing members (158) so that the projectile fixing members (158) are kept to given positions.

14. The shooting toy according to claim 1, wherein the projectile (200, 200*a*, 200*b*, 200*c*) has any one selected from spherical, circular, polyhedral, polygonal, and cylindrical forms.

15. The shooting toy according to claim 14, wherein the projectile (200, 200*a*, 200*b*, 200*c*) is made of a magnetic material or non-magnetic material.

16. The shooting toy according to claim 14, wherein the projectile (200) further comprises light emitting means disposed therein to emit light therefrom.

17. The shooting toy according to claim 14, wherein the projectile (200) further comprises at least one member selected from animal, object, characters, numbers, figures, and animation character disposed in an interior thereof.

18. The shooting toy according to claim 14, wherein the projectile (200*a*) comprises:

a projectile housing (210) having projectile through holes (211 and 212) formed on the center thereof to seat an auxiliary projectile (230) thereonto;

projectile elastic members (220) to restrain the auxiliary projectile (230); and the auxiliary projectile (230), which is fired by the binding force of the projectile elastic members (220).

19. The shooting toy according to claim 14, wherein the projectile (200*c*) comprises first and second projectile housings (210' and 210"), and if the projectile (200*c*) is shot to collide against the ground, an external form of the projectile (200*c*) transforms from a first form into a second form.

20. The shooting toy according to claim 19, wherein the first projectile housing (210') and the second projectile housing (210") of the projectile (200*c*) are separably coupled to each other.

21. The shooting toy according to claim 3, further comprising an auxiliary pressurizing part (300) coupled to one side of the support part (120*d*) to pressurize the projectile (200, 200*a*, 200*b*) thereagainst from the outside so that the projectile (200, 200*a*, 200*b*) is shot.

* * * * *